US011549275B2

(12) United States Patent
Heitsman

(10) Patent No.: US 11,549,275 B2
(45) Date of Patent: Jan. 10, 2023

(54) VOLUMETRIC MODULAR UNIT FOR MODULAR BUILDING CONSTRUCTION

(71) Applicant: Best GEN Modular, Inc., Rapid City, SD (US)

(72) Inventor: Michael Heitsman, Kansas City, MO (US)

(73) Assignee: BEST GEN MODULAR, INC., Rapid City, SD (US)

( * ) Notice: Subject to any disclaimer, the term of this patent is extended or adjusted under 35 U.S.C. 154(b) by 0 days.

(21) Appl. No.: 16/934,753

(22) Filed: Jul. 21, 2020

(65) Prior Publication Data

US 2022/0025663 A1 Jan. 27, 2022

(51) Int. Cl.

| | |
|---|---|
| ***E04H 1/00*** | (2006.01) |
| ***E04B 1/348*** | (2006.01) |
| ***E04C 3/11*** | (2006.01) |

(52) U.S. Cl.

CPC ..... *E04H 1/005* (2013.01); *E04B 1/3483* (2013.01); *E04B 1/34838* (2013.01); *E04B 1/34853* (2013.01); *E04C 3/11* (2013.01)

(58) Field of Classification Search

USPC ..... 52/79.1, 79.9, 293.1, 745.02

See application file for complete search history.

(56) References Cited

U.S. PATENT DOCUMENTS 2,564,691 A 8/1951 Mfred
3,540,173 A 11/1970 Johnides
4,067,159 A * 1/1978 Juriss ..... E04B 1/34853 52/234
4,106,243 A * 8/1978 Horn ..... E04B 1/3483 52/16
4,138,833 A * 2/1979 Townend ..... E04B 1/04 264/35
4,406,351 A * 9/1983 Littlejohn ..... A62B 1/02 182/142
4,620,404 A * 11/1986 Rizk ..... E04B 1/3483 52/235
4,644,708 A * 2/1987 Baudot ..... E04B 1/3483 52/123.1
4,788,802 A * 12/1988 Wokas ..... A47K 4/00 52/34
5,724,774 A 3/1998 Rooney
5,735,639 A * 4/1998 Payne ..... B65D 90/18 405/129.57

(Continued)

FOREIGN PATENT DOCUMENTS

JP 2013032681 A * 2/2013

*Primary Examiner* — Joshua K Ihezie

(74) *Attorney, Agent, or Firm* — Goodhue, Coleman & Owens, P.C.

(57) ABSTRACT

A volumetric modular unit constructed at a modular unit factory and shipped assembled to a modular building project site is disclosed. A modular building constructed from shipped volumetric modular units is also disclosed. Features of a volumetric modular unit and modular building are designed to account for and leverage traditional building practices. Shipping constraints often dictate volumetric modular unit design constraints. The volumetric modular unit and modular constructed building addresses both design needs and shipping constraints to leverage more economical resources available at a volumetric modular unit manufacturing plant.

20 Claims, 17 Drawing Sheets

(56) References Cited

U.S. PATENT DOCUMENTS 5,772,276 A * 6/1998 Fetz ..... B62D 25/2054 296/181.2
6,038,824 A * 3/2000 Hamrick, Sr. ..... E04B 1/34336 52/125.2
7,594,361 B2 * 9/2009 Tragant Ruano ... E04B 1/34823 220/1.5
8,082,718 B2 12/2011 Esbaum
9,169,631 B2 10/2015 Tate
9,702,138 B1 7/2017 Rutherford
10,155,621 B1 * 12/2018 Campbell ..... B65D 90/00
10,178,794 B1 * 1/2019 Bailey ..... H02G 3/283
10,196,809 B2 2/2019 Hall et al.
10,301,813 B1 * 5/2019 Hawkins ..... E04B 1/34336
2001/0047628 A1 * 12/2001 Mouton ..... E04B 1/3483 52/144
2002/0170243 A1 * 11/2002 Don ..... E04B 1/3483 52/79.7
2008/0178555 A1 * 7/2008 Green ..... E04C 3/17 52/690
2009/0134057 A1 * 5/2009 Hidalgo Vargas ..... B65D 11/1833 206/600
2010/0083607 A1 * 4/2010 Roig ..... E04B 1/34838 52/712
2010/0242405 A1 9/2010 Esbaum
2011/0036022 A1 2/2011 Hsu et al.
2011/0047889 A1 * 3/2011 Gad ..... E04B 5/10 52/79.1
2011/0162293 A1 * 7/2011 Levy ..... E04B 1/3483 52/79.9
2011/0173907 A1 7/2011 Katsalidis
2012/0169087 A1 * 7/2012 Griffin ..... B62D 25/2072 296/184.1
2013/0104994 A1 * 5/2013 Bettiol ..... E04B 7/18 137/1
2014/0000183 A1 * 1/2014 Perren ..... E04B 1/34869 52/79.5
2014/0137485 A1 5/2014 Lafferty, III et al.
2014/0260024 A1 9/2014 Tate
2014/0305856 A1 * 10/2014 Deskins ..... B01D 24/22 210/175
2014/0345217 A1 11/2014 Horton, III
2015/0322668 A1 11/2015 Quinn et al.
2016/0024779 A1 1/2016 Clus et al.
2016/0160515 A1 * 6/2016 Wallance ..... E04B 1/3483 52/79.1
2016/0333582 A1 * 11/2016 Xykis ..... E04B 1/34336
2016/0348369 A1 12/2016 Godfrey et al.
2017/0159290 A1 6/2017 Albright et al.
2017/0198489 A1 7/2017 Klein
2017/0334061 A1 * 11/2017 Gallup ..... B25J 1/00
2017/0362021 A1 * 12/2017 Kendall ..... B65D 90/0026
2018/0238046 A1 * 8/2018 Hillje ..... E04B 1/34869
2018/0273291 A1 * 9/2018 Scherrer ..... E04B 1/762
2018/0355603 A1 12/2018 Hall et al.
2019/0003195 A1 * 1/2019 Baker ..... E04H 3/02
2019/0153720 A1 * 5/2019 Bon ..... E04B 1/3483
2019/0234063 A1 8/2019 Ruiz
2019/0257070 A1 * 8/2019 Grosch ..... E04B 1/40
2019/0376303 A1 * 12/2019 Wolff ..... E02D 27/02

* cited by examiner

VOLUMETRIC MODULAR UNIT FOR MODULAR BUILDING CONSTRUCTION

FIELD OF THE INVENTION

This disclosure relates to volumetric modular units used in modular building construction. More particularly, but not exclusively, the disclosure relates to a volumetric modular unit for modular building construction.

BACKGROUND

Modular building construction is used to construct single floor and multi-floor projects. Complications, especially for multi-floor projects, can arise from modular unit height and shipping distance restrictions for highway transport from a modular unit construction plant to a modular building construction site, alignment and elevation issues between both stacked and adjacent modular units, alignment and elevation issues between both stacked and adjacent modular units for running plumbing, electrical, heating, ventilation, and air conditioning (HVAC), moisture ingress issues particularly between the ground and floor of a modular unit, issues sloping and draining water from exterior surfaces such as a roof, and issues spanning large open spaces or unsupported spans with a volumetric modular unit.

SUMMARY

Therefore, what is needed is an improved volumetric modular unit for modular building construction.

It is a primary object, feature, or advantage of the present disclosure to improve over and address limitations in the state of the art.

It is a further object, feature, or advantage of the present invention to provide a volumetric modular unit for modular building construction that addresses modular unit height and shipping distance restrictions for highway transport from a modular unit construction plant to a modular building construction site.

It is a still further object, feature, or advantage of the present invention to provide a volumetric modular unit for modular building construction that addresses alignment and elevation issues between both stacked and adjacent modular units.

Another object, feature, or advantage is to provide a volumetric modular unit for modular building construction that addresses alignment and elevation issues between both stacked and adjacent modular units for running plumbing and HVAC.

Yet another object, feature, or advantage is to provide a volumetric modular unit for modular building construction that addresses moisture ingress issues particularly between the ground and floor of a modular unit.

Still another object, feature, or advantage is to provide a volumetric modular unit for modular building construction that addresses issues sloping and draining water from exterior surfaces such as a roof.

A further object, feature, or advantage is to provide a volumetric modular unit having supporting structure fabricated into a floor structure of the volumetric modular unit for traversing unsupported spans with a volumetric modular unit.

According to one exemplary aspect of the disclosure, a volumetric modular unit for constructing a modular building is disclosed. The volumetric modular unit includes a floor structure and a ceiling structure interconnected by opposing side wall structures and opposing end wall structures, a plurality of wall studs disposed within the opposing side wall structures and the opposing end wall structures, a plurality of floor support members disposed within the floor structure, and a plurality of ceiling support members disposed within the ceiling structure. One or more of the plurality of ceiling support members have a vertical height that varies between the opposing end wall structures to provide a slope to the ceiling structure. In at least one preferred aspect, a roof is disposed atop the plurality of ceiling support members. The roof extends downwardly horizontally away from the opposing end wall structures following the slope from the variation in vertical height of the ceiling support members.

According to one exemplary aspect of the disclosure, a modular building constructed from volumetric modular units is disclosed. The modular building includes a modular building foundation having one or more block-outs for plumbing, and a volumetric modular unit supported by the foundation. The volumetric modular unit includes, for example, a floor structure and a ceiling structure interconnected by opposing side wall structures and opposing end wall structures. The floor structure includes one or more chases constructed at a volumetric modular unit factory corresponding with the one or more block-outs in the modular building foundation for connecting plumbing, a plurality of wall studs disposed within the opposing side wall structures and the opposing end wall structures, a plurality of floor support members disposed within the floor structure, and a plurality of ceiling support members disposed within the ceiling structure. The modular building includes one or more building floors having one or more of the volumetric modular units. The floor structure is disposed atop the modular building foundation and a load from the volumetric modular unit is transferred directly to the foundation. In at least one aspect, the modular building includes a spacer module operably attachable to the ceiling structure atop the volumetric modular unit. The spacer module has a height defined by a plurality of spacer module support members extending between opposing edge walls and opposing end walls. A height of the volumetric modular unit is increased by the height of the spacer module for maintaining elevation alignment along the one or more building floors of the modular building. In another aspect, the one or more multiple laminated lumbers are attached to the floor structure between the opposing end wall structures for carrying the load of the volumetric modular unit overtop an open area within the modular building.

According to one exemplary aspect of the disclosure, a volumetric modular unit for constructing a modular building is disclosed. The volumetric modular unit includes a removable floor structure and a ceiling structure interconnected by opposing side wall structures and opposing end wall structures, a plurality of wall studs disposed within the opposing side wall structures and the opposing end wall structures, a plurality of removable floor support members disposed within the removable floor structure, and a plurality of ceiling support members disposed within the ceiling structure. The removable floor is attached at a volumetric modular unit factory and removed after the volumetric modular unit is set in place for constructing a modular building. In at least one aspect, the volumetric modular unit includes a finished interior portion at least above the removable floor structure. The finished interior is provided at a volumetric modular unit factory. The volumetric modular unit also includes an unfished interior portion below the finished interior portion. The unfinished interior portion is finished at a modular building construction site.

One or more of these and/or other objects, features, or advantages of the disclosure will become apparent from the specification and claims that follow. No single aspect need provide each and every object, feature, or advantage. Different aspects may have different objects, features, or advantages. Therefore, the disclosure is not to be limited to or by any objects, features, or advantages stated herein.

BRIEF DESCRIPTION OF THE DRAWINGS

Illustrated aspects of the disclosure are described in detail below with reference to the attached drawing figures, which are incorporated by reference herein.

DETAILED DESCRIPTION

Figure 1:
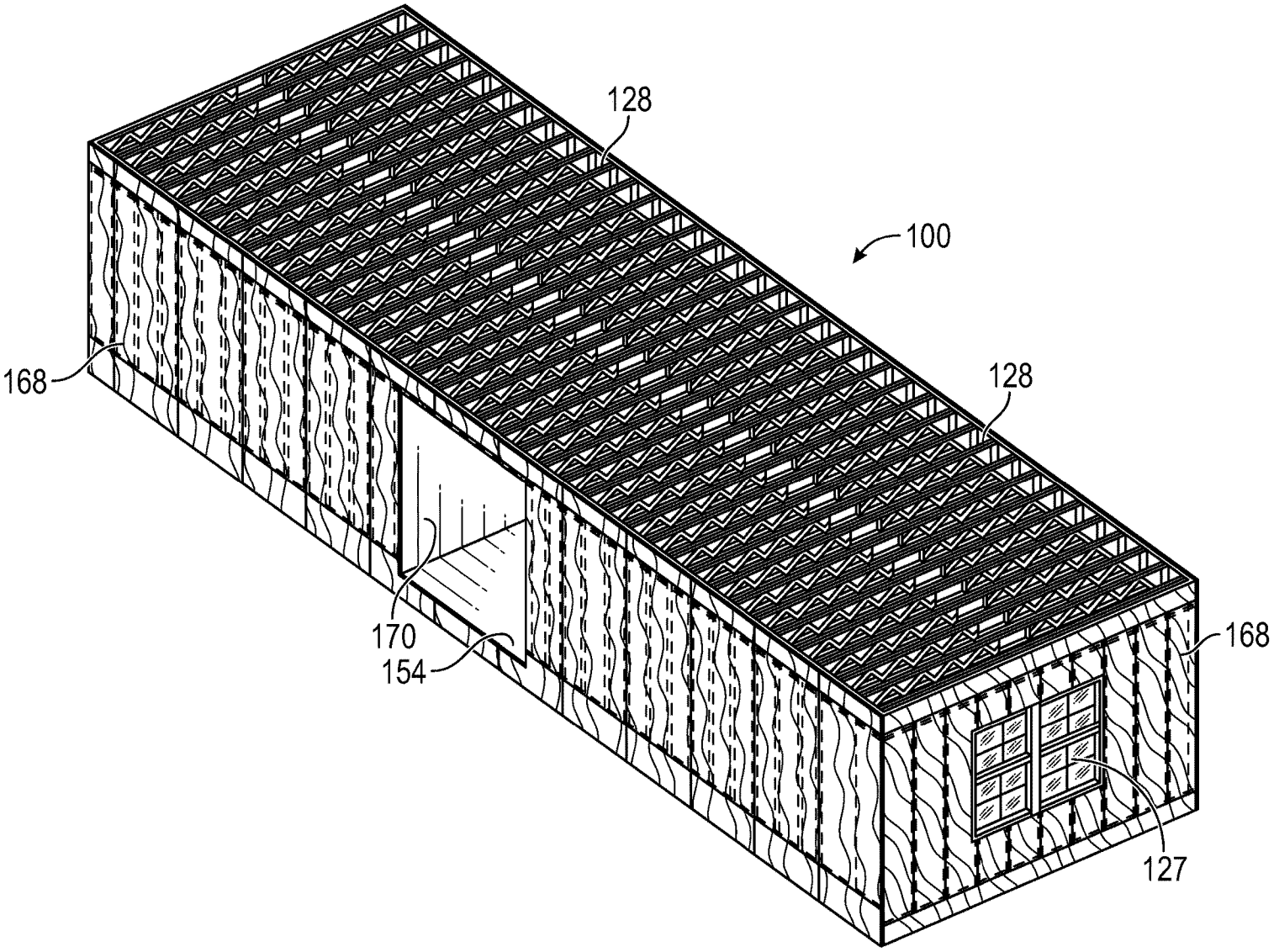
FIG. 1 is an isometric view of a volumetric modular unit in accordance with an illustrative aspect of the disclosure.
Figure 2:
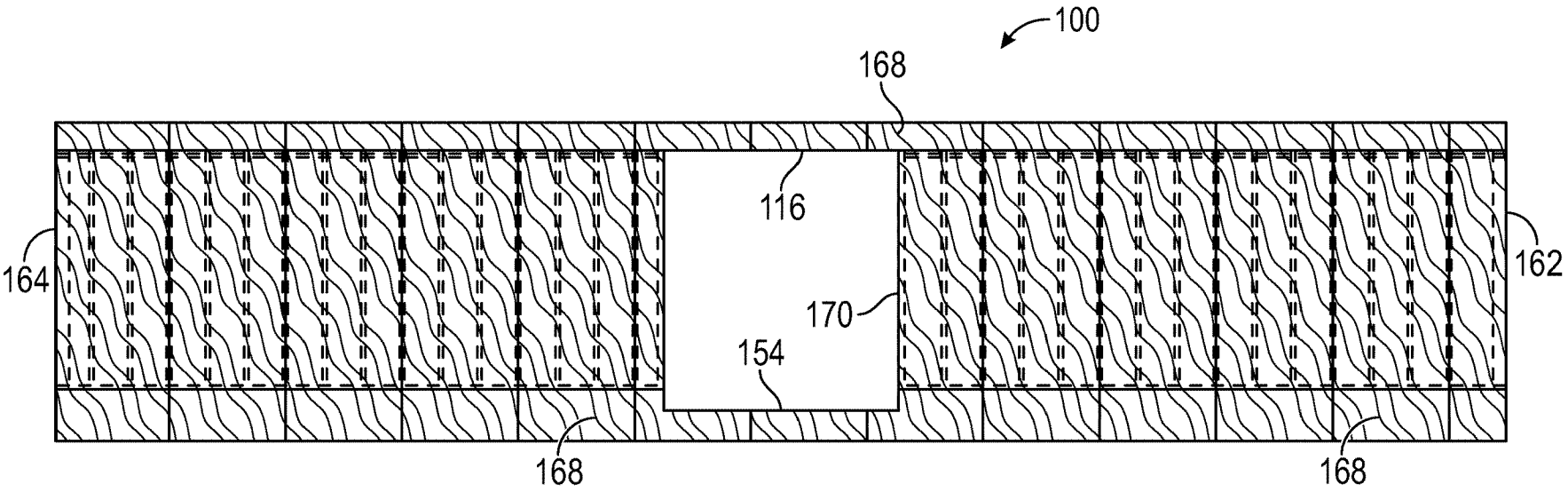
FIG. 2 is a side elevation view of the volumetric modular unit shown in FIG. 1.
Figure 3:
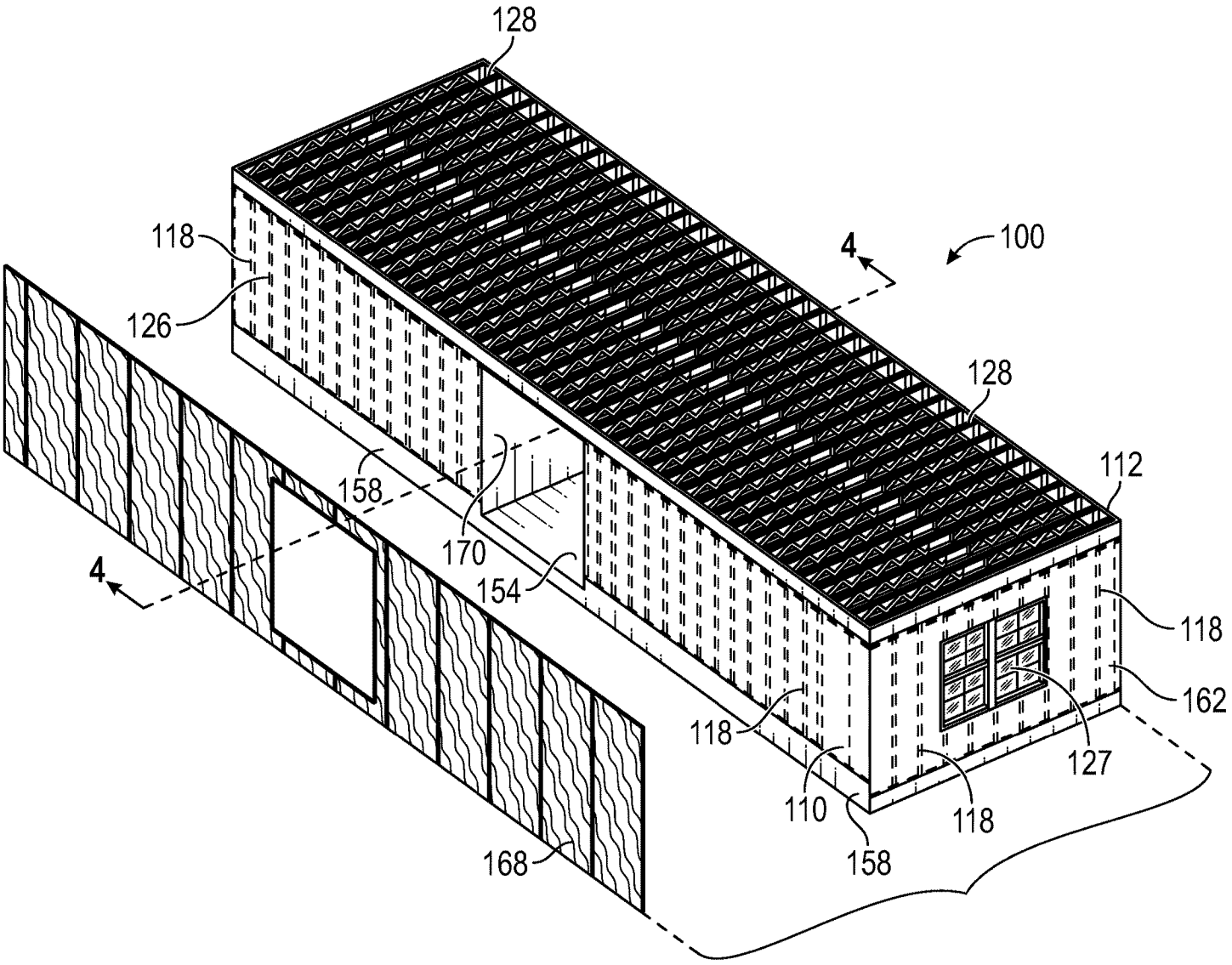
FIG. 3 is an isometric view of the volumetric modular unit shown in FIG. 1 with sheathing shown exploded for one side and removed from the other sides in accordance with an illustrative aspect of the disclosure.
Figure 4:
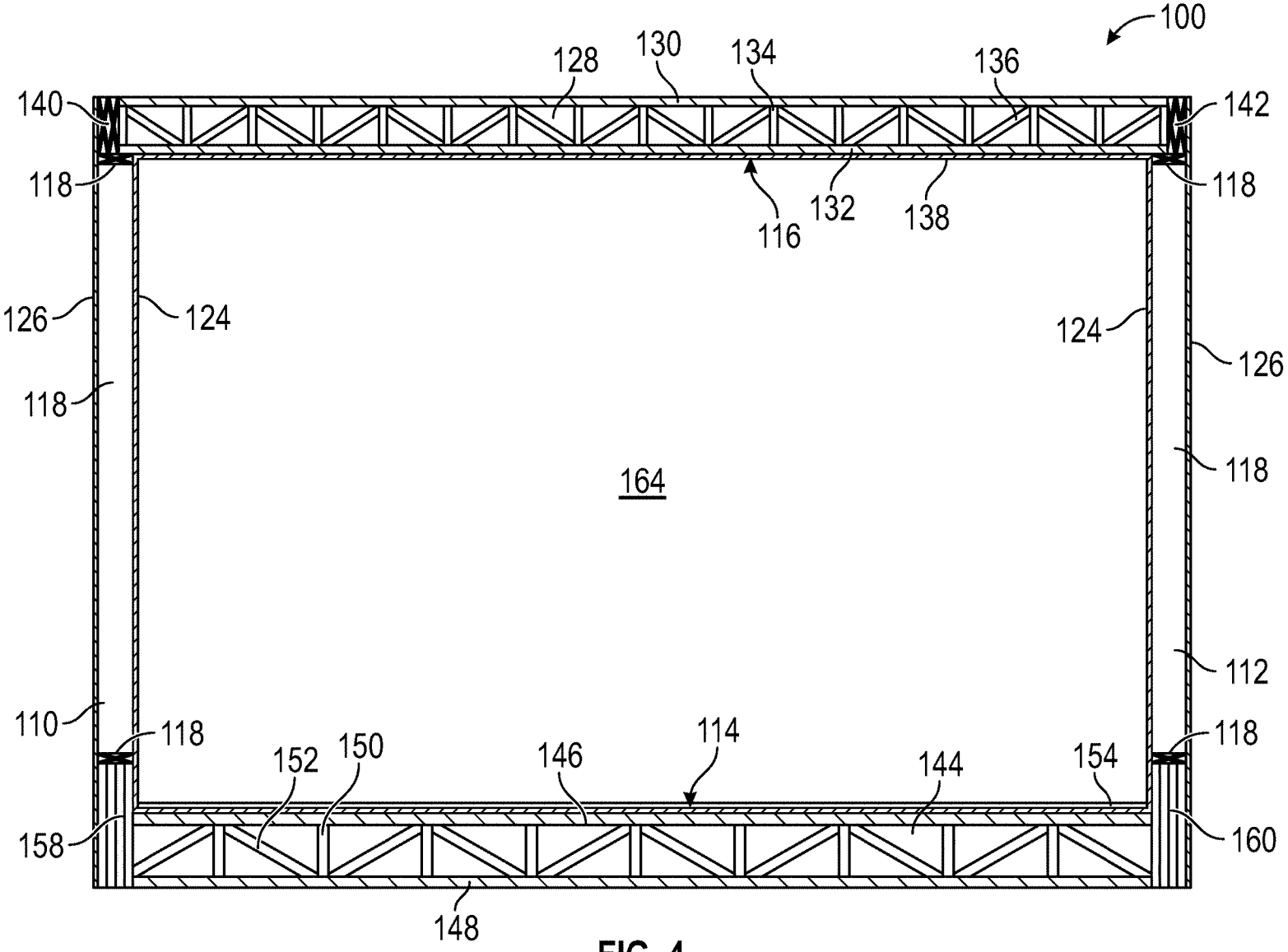
FIG. 4 is a cross-section view of the volumetric modular unit taken along line 4-4 in FIG. 3 illustrating reinforcing structure in the floor according to an exemplary aspect of the disclosure.

The disclosure provides solutions for volumetric modular units used for modular building construction projects, such as single floor and multi-floor modular building projects. For example, the disclosure provides solutions to the many complications, especially for multi-floor projects, that can arise from modular unit height and travel distance restrictions for highway transport from a modular unit construction plant to a modular building construction site, alignment and elevation issues between both stacked and adjacent modular units, alignment and elevation issues between both stacked and adjacent modular units for running plumbing and HVAC, and air conditioning, moisture ingress issues particularly between the ground and floor of a modular unit, issues sloping and draining water from exterior surfaces such as a roof, and issues spanning large open spaces or unsupported spans with a volumetric modular unit.

The modular building construction method utilizes "volumetric modular units," "modular units," "modulars," or "modules," as they are typically referred to within the industry, produced in a factory environment, transported to a project site, and together with other modular units and constructions materials are assembled into a final building configuration at a project or construction site. Each modular unit may include one or more habitable rooms in which the floor, walls, and ceiling are preassembled at a production facility for modular units, transported to the construction site, and then moved into their final position and fastened together before the exterior, façade or finishing touches of the modular constructed building are applied to the exterior, the adjoining interior spaces and the roof. The degree to which the modular units are finished at the production facility may vary, but can include installation, texturing, and painting of walls and ceilings; installation and finishing of doors, windows, and decorative trim; installation of carpet, tile, and other flooring; installation of lights, switches, outlets, plumbing, and HVAC systems; and installation of cabinets, counters and countertops, and even certain furniture and furnishings. In contrast, traditional site-built or stick-built construction requires delivering all of the necessary materials to the construction site where individual components and materials are fabricated and assembled into the final structure at the site, and specialized crews are hired to complete the installation of the aforementioned items and systems. Significant advantages of modular construction include performing the work in an enclosed facility protected from weather and the elements; efficiencies and improved quality arising from working in a factory setting with the assistance of tools and machinery that is not practical at an outdoor work site; and lower costs, shorter time to occupancy, and improved cash flow for the building owner resulting from these efficiencies and avoiding the need to hire skilled trade crews to work at the construction site.

Volumetric modular units are typically assembled or constructed at a modular building construction plant and shipped to a modular building construction site. Shipping limitations and restrictions, such as weight, height, and width limitations for highway transport, often complicate both construction of the volumetric modular unit and the modular building and the delivery of volumetric modular units to a modular building construction site. Modifications to volumetric modular units is sometimes required to meet engineering and design criteria for construction of a modular building. For example, modifications to the standard weight, height, width, and structure limitations of a volumetric modular unit are sometimes needed to meet engineering and design criteria for construction of a modular building. The type of foundation, build out of any non-modular constructed portions of the building, unsupported spans, roof type, parapet type, electrical, plumbing, and HVAC connections, and other considerations can create a need, from modular construction project to modular construction project, for minor or major modifications to a volumetric modular unit and other modules used in the modular building construction process. Improving both the speed and safety of fabrication of a modular building can be difficult given shipping constraints. Temporary and permanent features, particularly for safety reasons, are often constructed onsite using on a modular building using traditional non-modular building practices, which increases both the costs and time needed to fabricate the modular building. For example, a retaining fence or structure is often built onsite through the modular building process to prevent falling injuries from occurring. Similarly, a parapet for the roofing system is also constructed onsite and installed in place of a temporary retaining fence or structure atop a roof. Shipping restrictions are often the driver for these and other features being fabricated onsite instead of at a modular unit construction plant or factory. The present disclosure provides modifications to a volumetric modular unit, a modular constructed building, and the modular building construction process to address weight, height, width, and structural issues resulting from shipping limitations and restrictions.

A modular building can be constructed entirely from volumetric modular units; however, modular building construction often includes portions of the building, such as first floor, foundation, or other spaces, constructed using traditional or non-modular construction practices. Misalignment and elevation issues can arise between both stacked and adjacent volumetric modular units and the traditional or non-modular constructed portions of the building. For example, a portion of a modular constructed building can include traditional or non-modular constructed space designed to have a ceiling height exceeding the permissible or economically viable transportation height or distance of a volumetric modular unit. Measures to address the misalignment and/or elevation issues are typically undertaken at the modular building construction site and not the modular unit factory or plant. This can and often includes traditional or non-modular construction time spent at the modular building construction site building structures to address and remedy the misalignment and elevation issues, which slows construction, disrupts the setting of volumetric modular units in place, such as in the case of above floors, and increases overall cost of the build. The present disclosure provides modifications to a volumetric modular unit, a modular constructed building, and the modular building construction process to address misalignment and elevation between both stacked and adjacent volumetric modular units.

Fabrication of a volumetric modular unit and modular constructed building can present alignment and elevation issues between both stacked and adjacent modular units for running plumbing, electrical, and HVAC. This is further complicated when a modular constructed building includes portions, in addition to portions constructed from a volumetric modular unit, that are fabricated from non-modular construction or not fabricated from a volumetric modular unit. Chases and other conduits for housing and running plumbing, electrical, and HVAC can be included within the structure of a volumetric modular unit, portions of a modular building fabricated from a volumetric modular unit and portions of a modular building fabricated from non-modular construction. Misalignment and elevation issues between these and other parts of a modular building, including a foundation, can create present misalignment and elevation of chases and other conduits for housing and running plumbing, electrical, and HVAC. The present disclosure provides modifications to a volumetric modular unit, a modular constructed building, and a modular building construction process to address issues between both stacked and adjacent modular units for running plumbing, electrical, and HVAC.

Moisture ingress issues particularly between the ground or foundation and a floor of a modular unit can present many problems. Excess moisture can lead to mold, mildew, and contamination issues. Excess moisture can also speed deterioration, failure, and the need for repairs sooner than later. Modular constructed buildings can be set on a foundation fabricated from different materials, such as concrete, wood, or compacted soil. In some instances, a crawl space is fabricated atop a foundation or provides a foundation itself. In addition to moisture issues, the type of foundation or structure upon which a volumetric modular unit is set upon can invite and contribute to accelerated bug and animal infestation. The present disclosure provides modifications to a volumetric modular unit, a modular constructed building, and a modular building construction process to address issues particularly between the ground or foundation and a floor of a modular unit.

Modular building construction can experience issues sloping and draining water from exterior surfaces such as a roof. In ordinary construction (i.e., non-modular construction), a flat roof is generally fabricated from roof trusses that all have the same height, which means the roof trusses themselves provide no slope to the roof Roof sloop is provided however by using insulation that is part of a thermoplastic polyolefin (TPO) or ethylene propylene diene terpolymer (EPDM) roofing system. TPO roofing systems are made up of a single layer of synthetics and reinforcing scrim that can be used to cover flat roofs. EPDM is a synthetic rubber roofing membrane widely used in low-slope buildings. Roof drains are typically centered in the roofing system. Traditional modular roofing systems also generally include a roof with roof trusses that all have the same height, which means that the roof trusses themselves provide no slope to the roof Roof slope is incorporated with the insulation that is generally part of the TPO/EPDM roofing system. The insulation is tapered to provide a slope to the roofing system. Roof drains are typically centered in the roofing system. The present disclosure provides modifications to a volumetric modular unit, a modular constructed building, and a modular building construction process to address issues sloping and draining water from exterior surfaces such as a roof.

Issues spanning large open spaces or unsupported spans of a building with a volumetric modular unit can be problematic, especially when the supporting structure is contained exclusively within the structure of a volumetric modular unit. Proper support for the individual modular units is vital to ensuring the assembled modular constructed building maintains its structural integrity over time and provides a safe and pleasant environment for its occupants. This support may be provided in various ways, including a slab on grade in which the modular units rest directly on a concrete slab at ground level, a below-grade basement or crawl space in which the modular units are supported by a foundation and vertical walls, or a "podium" in which the first floor is constructed using traditional non-modular building techniques and the modular units are placed on top of the first floor podium. Buildings constructed or assembled from modular units may include a single story or may be stacked on top of one another and side-by-side to create a structure several stories tall. In certain building designs, it may be desirable to create large open spaces. Examples from residential construction include living or recreational spaces in a single-family home or multi-family apartment building or condominium. In commercial construction, examples include areas such as lobbies, conference rooms, ballrooms, fitness areas, dining areas, recreational areas, and indoor swimming pools where support structures including walls, columns, and piers would interfere with the activity taking place in the space, run array of architectural plans or detract from the aesthetics and visual appeal of the facility. Alternatives to walls, columns, and piers exist and may include structural elements like laminated wood beams or steel beams, girders, and trusses over the open space to provide support for the building structure above the open space. These alternatives are very expensive, require structural analysis to ensure their adequacy, and require costly crews, equipment, and time to install them properly while the building is being constructed. The present disclosure provides modifications to a volumetric modular unit, a modular constructed building, and a modular building construction process to address issues spanning large open spaces or unsupported spans of a building with a volumetric modular unit by including structure to provide support contained within the buildout of a volumetric modular unit for spanning over large open spaces in a modular constructed building. While individual modular units used in modular building construction must be robustly constructed to withstand the rigors of being transported from the production facility to the construction site, the integration of a reinforcing structure during the building of a modular unit can further increase the rigidity and structural integrity and strength of the modular unit to the point where it no longer requires support from below and can span such large open spaces without disruptive walls, columns or piers or costly beams, girders, or trusses disposed beneath. By building a reinforcing structure within the floor of an individual modular unit, the entire modular unit becomes a structural truss capable of spanning large open spaces without interior support elements from below. The reinforcing structure may take the form of single or multiple laminated lumbers, such as laminated veneer lumber (LVL) or parallel strand lumber (PSL), integrated into the floor structure of a modular unit. In one aspect, traditional bottom rim joists attached to floor trusses are configured with single or multiple laminated lumbers, depending on the structural rigidity needed in each modular unit. This structure withstands the tensile and compressive forces necessary to prevent the module from sagging downward, thereby eliminating the need for the underlying supports such as walls, columns, piers, beams, girders, and trusses.

FIGS. 1-17 disclose a volumetric modular unit, a modular constructed building, and a modular building and volumetric modular unit fabrication method that addresses deficiencies by providing improvements to the art.

The figures disclose exemplary aspects of a laminated lumber constructed modular unit 100 for modular building construction, where reinforcing structure takes the form of single or multiple laminated lumbers integrated into structural elements of the modular unit. The reinforcing structure may be integrated into the floor, walls, and roof. In a preferred aspect, the reinforcing structure may be integrated into the floor. In a preferred aspect, the reinforcing structure may be integrated into the floor and wall. In one aspect, the reinforcing structure may be integrated into the roof. In another aspect, the reinforcing structure may be integrated into the roof and wall.

Modular unit 100 includes opposing walls 110 and 112 connected to an opposing floor 114, ceiling 116, and end walls 162, 164. Walls 110, 112 are framed from dimensional lumber such as 2×4s (e.g., for interior walls) or 2×6s (e.g., exterior walls) and include wall studs 118 connected between a top plate 120 and a bottom plate 122. Walls 110, 112 may include a single or double top plate 120, wall studs 118 and a single or double bottom plate 122 or sole plate. The interior side of walls 110 typically include an interior wall 124 of sheetrock and the exterior side of walls 110, 112 typically include an exterior wall 126, of one or more reinforcing structures, such as sheathing 168 with chipboard/particle board or oriented strand bord (OSB). Walls 110, 112 may be framed to include one or more windows 127. Any suitable mechanism for constructing walls 110, 112 along with other features may be used, including bolts and nuts, lag bolts, screws, nails, and/or structural adhesives.

The ceiling 116 includes ceiling trusses 128 with a top chord 130 and bottom chord 132 connected by webs, such as a post 134 and diagonal 136. The interior side of ceiling 116 typically includes an interior ceiling 138 of sheetrock. Opposing top rim joists 140, 142 are connected to opposing ends of the ceiling trusses 128 and the top plate 120 of walls 110, 112 providing a reinforcing structure to the modular unit 100. Top rim joists 140, 142 can be constructed from dimensional lumber, such as doubled or tripled-up 2×10s or 2×12 s. Any suitable mechanism for assembling ceiling 116, ceiling trusses 128, top rim joists 140, 142 and walls 110, 122 along with other features may be used, including bolts and nuts, lag bolts, screws, nails, and/or structural adhesives.

The floor 114 includes a floor truss 144 with a top chord 146 and bottom chord 148 connected by webs, such as a post 150 and diagonal 152. The interior side of floor 114 typically includes a subfloor 154 and finished floor 156. Other suitable sizes, arrangements and construction of floor trusses 144 are contemplated. For example, floor truss 144 may be constructed from two-by solid lumber, such as 2 inches by 8 inches, 2 inches by 10 inches, 2 inches by 12 inches, with various spacing. Other suitable sizes, arrangements and construction of the floor trusses 144 are also contemplated, such as, for example, a truss joist, I-joist, and a metal web system (e.g., Posi-Struts by MiTek). Opposing bottom one or multiple laminated lumbers 158, 160 are connected to opposing ends of the floor truss 144 and the bottom plate 122 of walls 110, 112 providing a reinforcing structure to the modular unit 100. One or multiple laminated lumbers 158, 160 can be constructed from laminated veneer lumber (LVL), such as, for example, 5¼ inch by 20 inches by 16 foot pieces of LVL staggered and offset across a full length (e.g., 65 feet) of the modular unit 100. Other suitable sizes, arrangements and construction of the LVL are contemplated), such as, for example, 1¾ inch by 11⅞ inches by 16 foot pieces of LVL stacked multiples together, staggered and offset across a full length of the modular unit 100 and 1¾ inch by 7¼ inches by 16 foot pieces of LVL stacked multiples together, staggered and offset across a full length of the modular unit 100. One or multiple laminated lumbers 158, 160 can be constructed from parallel strand lumber (PSL), such as, for example, 5½ inch by 22 inches by 16 foot pieces of PSL staggered and offset across a full length of the modular unit 100. Other suitable sizes, arrangements, and construction of the PSL are contemplated. Although the one or multiple laminated lumbers 158, 160 are contemplated as being constructed from LVL and PSL. The present disclosure also contemplates construction from Glue Laminated Timber (Glulam), Cross-Laminated Timber (CLT), Nail Laminated Timber (NLT), Dowel Laminated Timber (DLT), and the like. The present disclosure also contemplates using solid lumber in place of the one or more laminated lumbers 158, 160. Any suitable mechanism for assembling floor 114, one or multiple laminated lumbers 158, 160 and walls 110, 112 along with other features may be used, including bolts and nuts, lag bolts, screws, nails, and/or structural adhesives.

The end walls 162, 164 are framed from dimensional lumber such as 2×4s or 2×6s and include wall studs 118 connected between a top plate 120 and a bottom plate 122. The interior side of walls 110 of end walls 162, 164 typically includes an interior wall 124 of sheetrock and the exterior side of end walls 162, 164 includes an exterior wall 126, of one or more reinforcing structures, such as sheathing 168 with chipboard/particle board or oriented strand bord (OSB). End walls 162, 164 may be framed to include one or more windows 166. Any suitable mechanism for constructing walls 110, 112 and other features may be used, including bolts and nuts, lag bolts, screws, nails, and/or structural adhesives.

Figure 5:
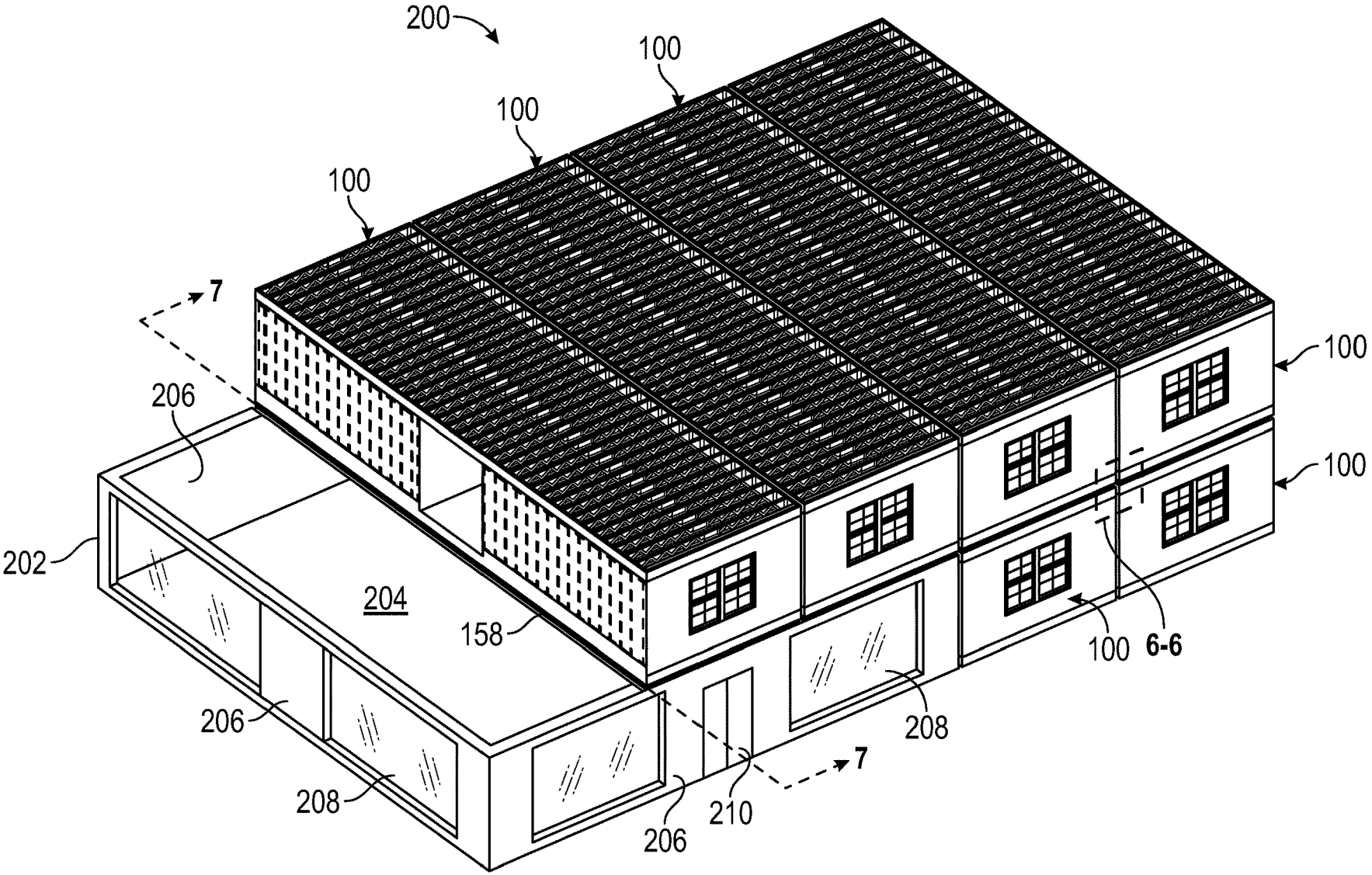
FIG. 5 is an isometric view of a modular constructed building with sheathing removed for illustrating reinforcing structure in the floor in accordance with an exemplary aspect of the disclosure.
Figure 7:
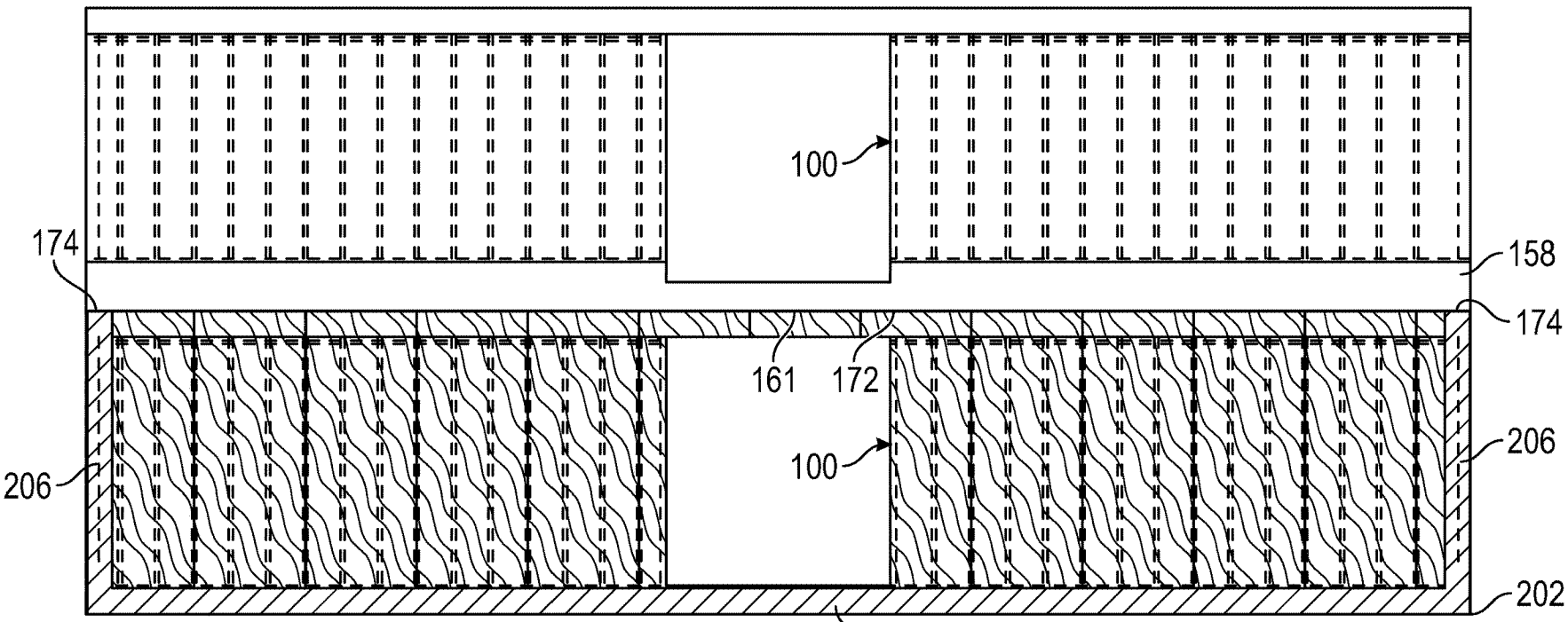
FIG. 7 is a cross-section view of the modular constructed building taken along line 7-7 in FIG. 5 illustrating a span of the volumetric unit above an open space within the modular constructed building in accordance with an exemplary aspect of the disclosure.
Figure 8:
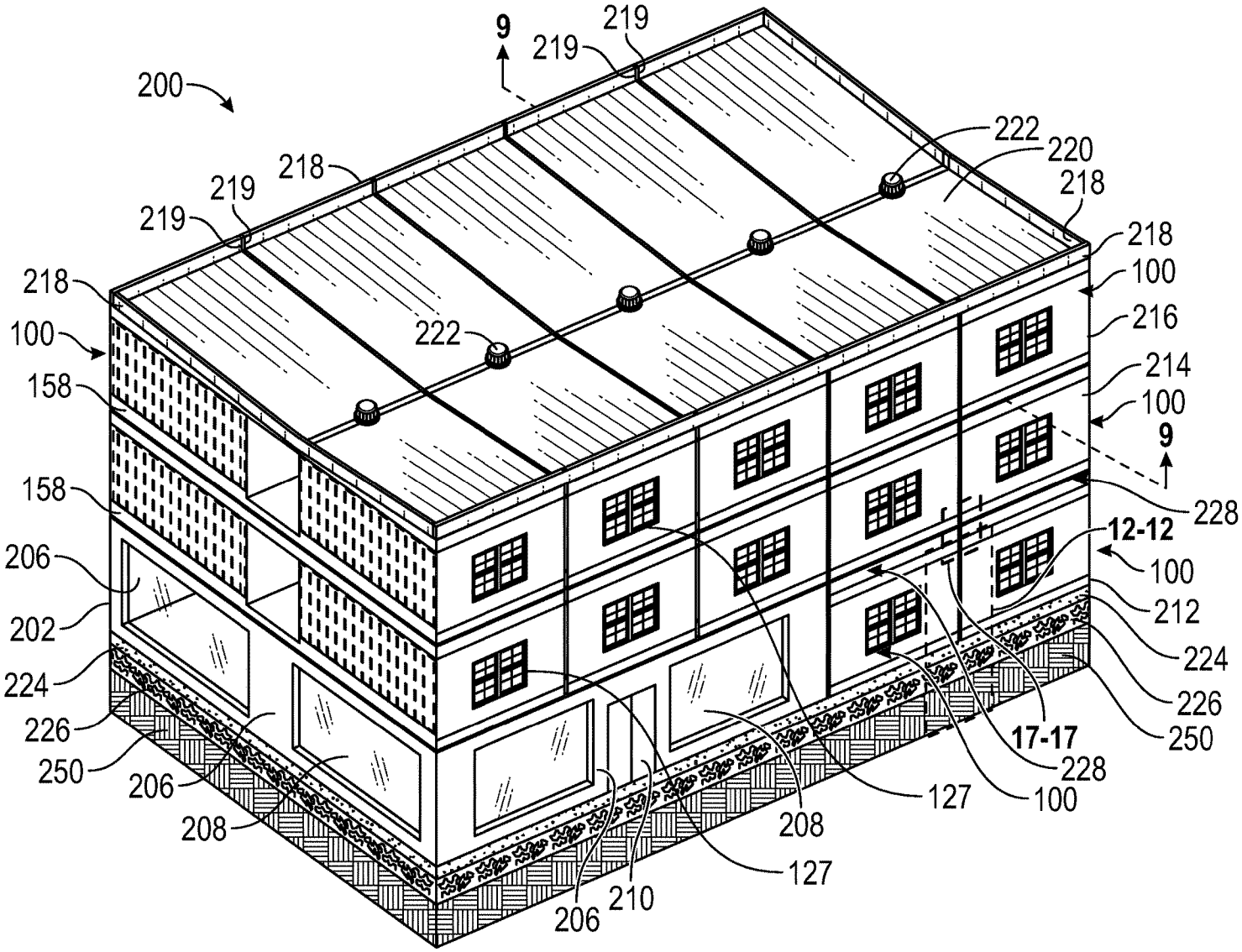
FIG. 8 is an isometric view of a modular constructed building with sheathing removed from one side for illustrating in accordance with an exemplary aspect of the disclosure.

An assembled modular unit 100 includes, for example, opposing walls 110, 112 spaced apart by the ceiling 116 and floor 114 and enclosed by opposing end walls 162, 164, as best shown in FIGS. 5, 7, and 8. The one or more multiple laminated lumbers 158, 160 are configured as part of floor 114, are disposed parallel of each other on opposing sides of the modular unit 100 and run the entire length of the modular unit 100 between opposing end walls 162, 164. Thus, for example, opposing end walls 162, 164 can be mounted atop a floor 204 and vertical walls 206, or a "podium" 202 in which the first floor is constructed using traditional non-modular building techniques creating a large open space beneath the unsupported span 161 of the modular unit that is unobstructed from and can span such large open spaces without disruptive walls, columns or piers or costly beams, girders, or trusses. The unsupported span 161 includes an unsupported portion 172 and a supported portion 174. The unsupported portion 172 extends between opposing supported portions 174. For example, as shown in FIG. 7, vertical walls 206 of podium 202 provide the supported portion 174 underneath the one or more multiple laminate lumbers 158, 160. The unsupported portion 172 spans across the floor 204 between opposing vertical walls 206 of the podium 202 providing the unsupported span 161 of the modular unit 100. In another aspect, depending on the design requirements for the modular unit constructed building 200, the one or multiple laminated lumbers 158, 160 have an unsupported span 161 that is configured to span unsupported portions of the floor 114 of the modular unit 100, using other types of reinforcement for supported portions of the floor 114. In another aspect, depending on the design requirements for the modular unit constructed building 200, the one or multiple laminated lumbers 158, 160 could be configured to span one or more portions of the ceiling or the entirety of the ceiling such as top rim joists 140, 142.

An assembled modular unit constructed building 200 includes, for example, modular units 100 set upon a slab on grade in which the modular units rest directly on a concrete slab at ground level, a below-grade basement or crawl space in which the modular units are supported by a foundation and vertical walls, or a "podium" in which the first floor is constructed using traditional non-modular building techniques and the modular units 100 are placed on top of the first floor podium.

Figure 6:
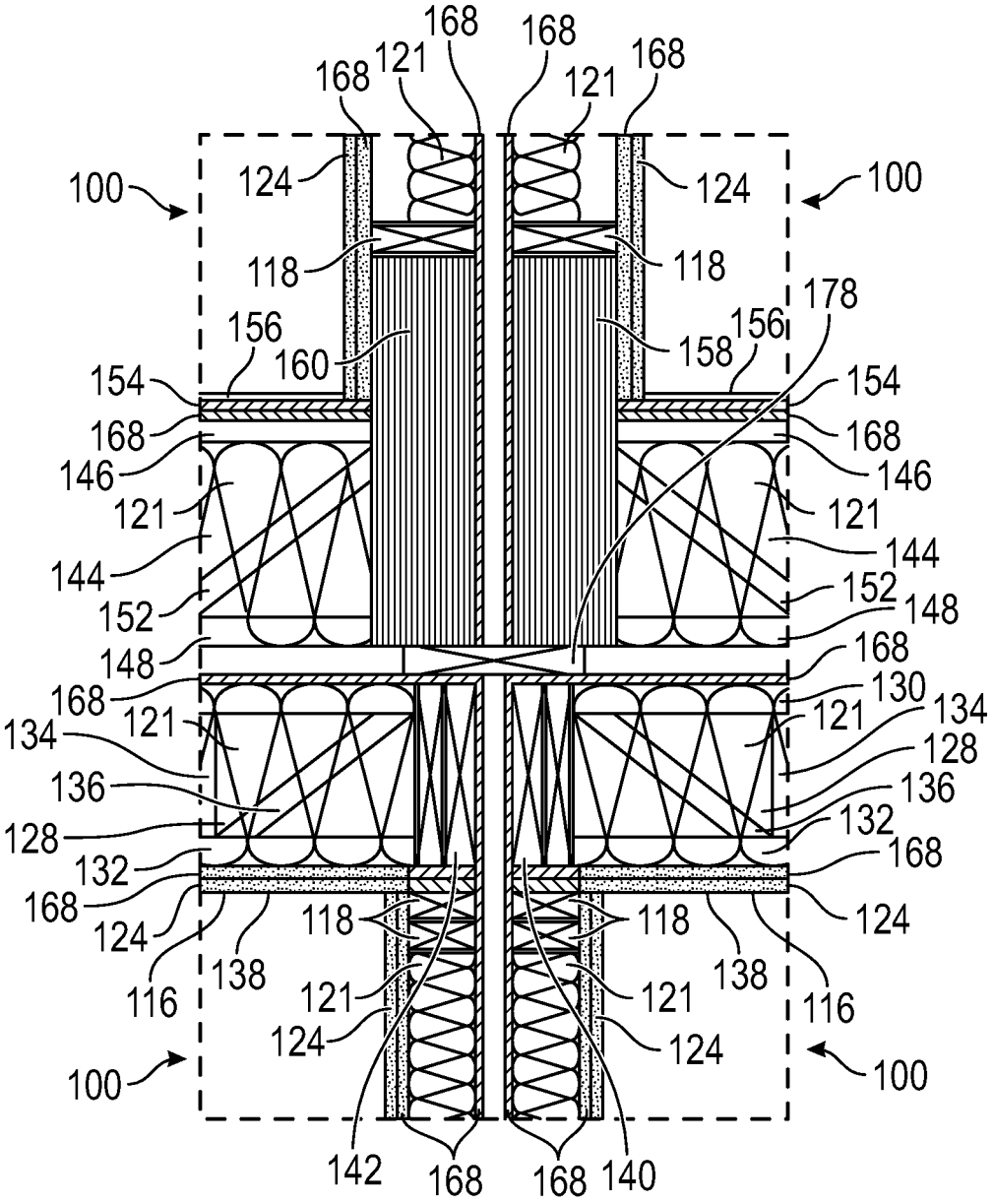
FIG. 6 is a section view of the modular constructed building taken along line 6-6 in FIG. 5 illustrating mating and connection between modular units in accordance with an exemplary aspect of the disclosure.

FIG. 6 provides an exemplary illustration for the orientation, mating and connection of at the floor 113 and walls 110, 112 of each modular unit 100 of the assembled modular unit constructed building 200. Adjoining floor 114 portions of modular units 100 are illustrated pictorially at the top of the figure. Adjoining ceiling 116 portions of the modular units 100 are illustrated pictorially at the bottom of the figure and discussed below. Left and right adjoining walls 110, 112 are framed from dimensional lumber such as 2×4s (e.g., for interior walls) or 2×6s (e.g., exterior walls) and include wall studs 118 connected between a top plate 120 and a bottom plate 122. The wall studs 118 may be spaced apart 16" on-center (O.C.). Insulation 121, such as sound attenuation batting (SAB) insulation or other suitable insulations, may be disposed within walls 110, 112, such as between wall studs 118. The interior side of walls 110 typically include an interior wall 124 of sheetrock, such as one or multiple layers of ⅝" gypsum wall board (GWB) and the exterior side of walls 110, 112 includes an exterior wall 126, of one or multiple reinforcing structures, such as sheathing 168 with chipboard/particle board or oriented strand bord (OSB), such as 7/16" OSB sheathing 168.

End walls 162, 164 of each modular unit 100 may be framed to include one or more windows 127. Walls 110, 112 that are on the exterior of the modular unit constructed building 200 may also include one or more windows 127. Any suitable mechanism for constructing walls 110, 112 and other features may be used, including bolts and nuts, lag bolts, screws, nails, and/or structural adhesives.

The floor 114 of each adjoining modular unit 100 includes a floor truss 144 with a top chord 146 and bottom chord 148 connected by webs, such as a post 150 and diagonal 152. The floor truss 144 may be any type of floor truss, such as an 11⅞" floor truss spaced apart 16" O.C. or other suitable floor trusses and spacing. Other suitable sizes, arrangements, and construction of floor trusses 144 are contemplated. For example, floor truss 144 may be constructed from two-by solid lumber, such as 2 inches by 8 inches, 2 inches by 10 inches, 2 inches by 12 inches, with various spacing. Other suitable sizes, arrangements, and construction of the floor trusses 144 are also contemplated, such as, for example, a truss joist, I-joist, and a metal web system (e.g., Posi-Struts by MiTek). Insulation 121, such as sound attenuation batting (SAB) insulation, unfaced batting insulation or other suitable insulations, may be disposed within floors 114. The interior side of floor 114 typically includes a subfloor 154, such as 23/32" OSB or other suitable sheathing 168, and a finished floor 156, such as carpet, wood, linoleum, and tile. One or multiple laminated lumbers 158 are connected to the floor truss 144 and the bottom plate 122 of wall 110 and one or multiple laminated lumbers 160 are connected to the floor truss 144 and the bottom plate 122 of wall 112 thereby providing a reinforcing structure to each modular unit 100.

One or multiple laminated lumbers 158, 160 can be constructed from laminated veneer lumber (LVL), such as, for example, 5¼ inch by 20 inches by 16 foot pieces of LVL staggered and offset across a full length (e.g., 65 feet) of the modular unit 100. Other suitable sizes, arrangements and construction of the LVL are contemplated), such as, for example, 1¾ inch by 11⅞ inches by 16 foot pieces of LVL stacked multiples together, staggered and offset across a full length of the modular unit 100 and 1¾ inch by 7¼ inches by 16 foot pieces of LVL stacked multiples together, staggered and offset across a full length of the modular unit 100. One or multiple laminated lumbers 158, 160 can be constructed from parallel strand lumber (PSL), such as, for example, 5½ inch by 22 inches by 16 foot pieces of PSL staggered and offset across a full length of the modular unit 100. Other suitable sizes, arrangements and construction of the PSL are contemplated. Although the one or multiple laminated lumbers 158, 160 are contemplated as being constructed from LVL and PSL. The present disclosure also contemplates construction from Glue Laminated Timber (Glulam), Cross-Laminated Timber (CLT), Nail Laminated Timber (NLT), Dowel Laminated Timber (DLT), and the like. The present disclosure also contemplates using solid lumber in place of the one or more laminated lumbers 158, 160. Any suitable mechanism for assembling floor 114, one or multiple laminated lumbers 158, 160 and walls 110, 112 along with other features may be used, including bolts and nuts, lag bolts, screws, nails, and/or structural adhesives.

FIG. 6 also provides an exemplary illustration for the orientation, mating and connection at the ceiling 116 and walls 110, 112 of each modular unit 100 of the assembled modular unit constructed building 200. Adjoining ceiling 116 portions of the modular units 100 are illustrated pictorially at the bottom of the figure. Adjoining floor 114 portions of modular units 100 are illustrated pictorially at the top of the figure and discussed above. Left and right adjoining walls 110, 112 are framed from dimensional lumber such as 2×4s (e.g., for interior walls) or 2×6s (e.g., exterior walls) and include wall studs 118 connected between a top plate 120 and a bottom plate 122. The wall studs 118 may be spaced apart 16" on-center (O.C.). Insulation 121, such as sound attenuation batting (SAB) insulation or other suitable insulations, may be disposed within walls 110, 112, such as between wall studs 118. The interior side of walls 110 typically include an interior wall 124 of sheetrock, such as one or multiple layers of ⅝" gypsum wall board (GWB) and the exterior side of walls 110, 112 includes an exterior wall 126, of one or multiple reinforcing structures, such as sheathing 168 with chipboard/particle board or oriented strand bord (OSB), such as 7/16" OSB sheathing 168.

End walls 162, 164 of each modular unit 100 may be framed to include one or more windows 127. Walls 110, 112 that are on the exterior of the modular unit constructed building 200 may also include one or more windows 127. Any suitable mechanism for constructing walls 110, 112 and other features may be used, including bolts and nuts, lag bolts, screws, nails, and/or structural adhesives.

The ceiling 116 of each adjoining modular unit 100 includes ceiling trusses 128 with a top chord 130 and bottom chord 132 connected by webs, such as a post 134 and diagonal 136. The ceiling trusses 128 may be any type of ceiling truss, such as a 9¼" ceiling trusses spaced apart 24" O.C. or other suitable ceiling trusses and spacing. Insulation 121, such as faced/unfaced batting insulation, sound attenuation batting (SAB) insulation, or other suitable insulations, may be disposed within ceiling 116. The interior side of ceiling 116 typically includes an interior ceiling 138 of sheetrock, such as one or multiple layers of ⅝" gypsum wall board (GWB) or other suitable wall boards. Top rim joist 142 of the left modular unit 100 are connected to the ends of the ceiling trusses 128 and the top plate 120 of wall 112 providing a reinforcing structure to the left modular unit 100. Similarly, top rim joist 140 of the right modular unit 100 are connected to the ends of the ceiling trusses 128 and the top plate 120 of wall 110 providing a reinforcing structure to the right modular unit 100. Top rim joists 140, 142 can be constructed or assembled from dimensional lumber, such as doubled or tripled-up 2×10s or 2×12s, or other suitable lumber. Any suitable mechanism for assembling ceiling 116, ceiling trusses 128, top rim joists 140, 142 and walls 110, 112 along with other features may be used, including bolts and nuts, lag bolts, screws, nails, and/or structural adhesives.

FIG. 6 also provides an exemplary illustration for the orientation, mating, and connection at the ceiling 116 and floor 114 of each modular unit 100 of the assembled modular unit constructed building 200. In one aspect, a crush plate 178 constructed from dimensional lumber, such as 2×8s, 2×10s, 2×12s, or other suitable dimensions, is disposed between the ceilings 116 and floors 114 of modular units 100 assembled together into a modular unit constructed building 200. Crush plate 178, also known as an anti-crush plate, are generally used to avoid crushing of the lumber at supports of heavily loaded lumber trusses on wall frames. Crush plate 178 accomplishes this by increasing the width of the bearing and therefore the bearing capacity. Crush plate 178 is typically disposed underneath the one or more multiple laminated lumbers 160 of the left modular unit 100, underneath the one or multiple laminated lumbers 158 of the right modular unit 100, above the top rim joist 142 of the left modular unit 100, above the top rim joist 140 of the right modular unit, and spanning gaps 186, 190 between both the left and right modular units 100. Modular units 100 are assembled so common features align, such as a hallway 170, breezeway or corridor. Any suitable mechanism for assembling the crush plate 178, the one or more multiple laminated lumbers 160 of the left modular unit 100, the one or multiple laminated lumbers 158 of the right modular unit 100, the top rim joist 142 of the left modular unit 100, and the top rim joist 140 of the right modular unit, along with other features may be used, including bolts and nuts, lag bolts, screws, nails, and/or structural adhesives.

Figure 12:
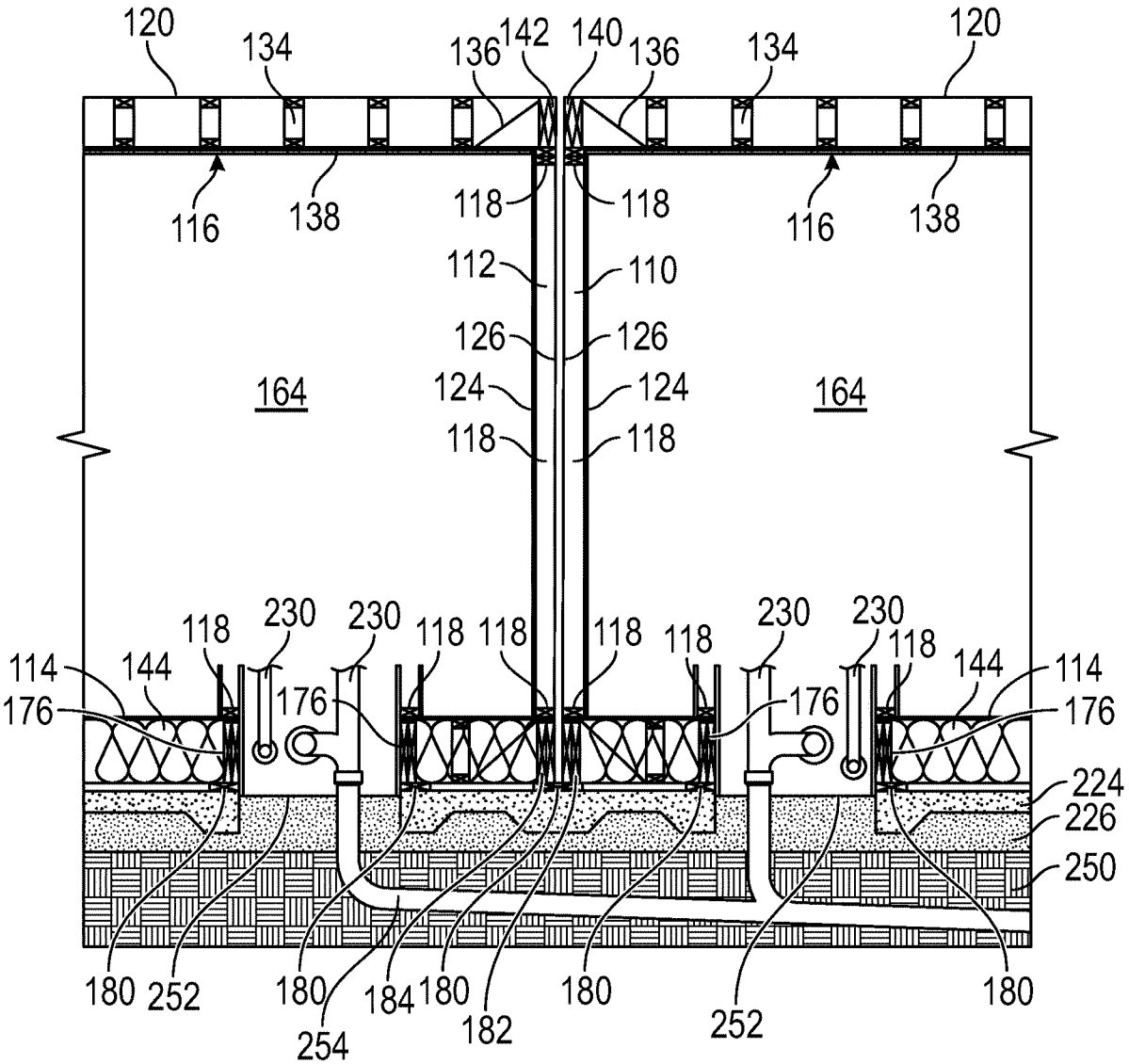
FIG. 12 is a sectional view of a pair of volumetric modular units of the modular constructed building taken along line 12-12 in FIG. 8 illustrating a slab-on-grade aspect of the disclosure.
Figure 13:
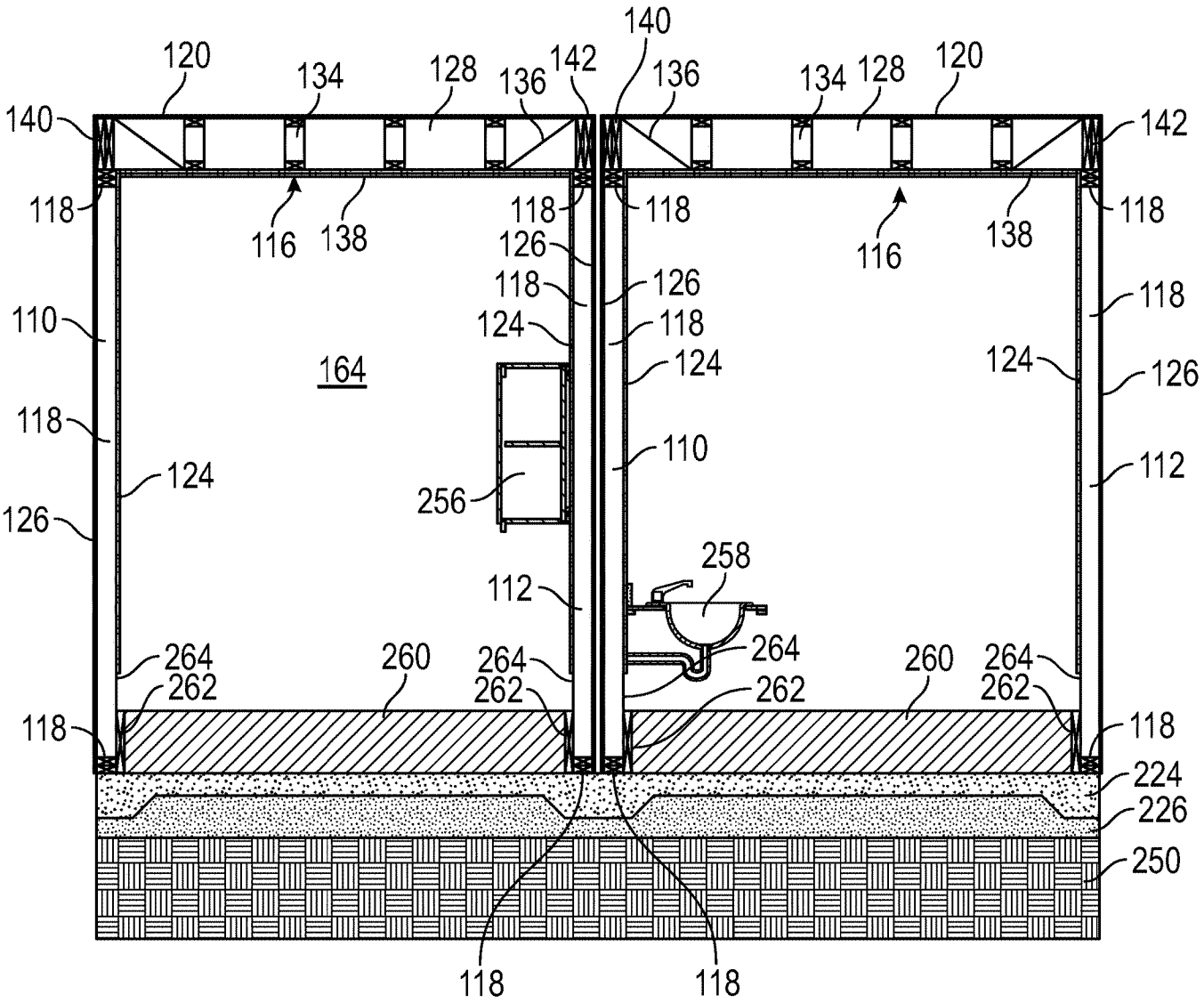
FIG. 13 is another view of FIG. 12 illustrating additional slab-on-grade aspect of the disclosure.

FIG. 8 provides another exemplary illustration of FIG. 5 showing a modular unit constructed building 200 or a modular building 200 constructed from volumetric modular units 100. The building 200 illustrates a first floor 212, second floor 214, and third floor 216. The number of floors can vary from building 200 to building 200. The building 200 is typically constructed atop of a foundation 224 such as concrete or wood foundation, set upon a subfoundation 226, which are both supported by earth 250 below. In some aspects, volumetric modular units 100 are set directly upon the foundation 224. In other aspects, volumetric modular units 100 are set upon a crawlspace fabricated from dimensional lumber of a suitable wood type. Portions of the building 200 constructed by non-modular fabrication, such as a podium 202, can be also be constructed atop of the foundation 224, subfoundation 226, which are both supported by earth 250 below. FIGS. 12 and 13 show a cross section of the building 200 illustrating a portion of the volumetric modular units 100 and foundation 224, subfoundation 226, and earth 250 below. The foundation 224 can include one or more foundation block-outs 252 for electrical, plumbing 230 (e.g., water and sewer), gas, cable, internet, and other utilities.

FIGS. 12-13 also illustrate a portion of floor 114 and walls for adjoining modular units 100 disposed next to each other on a foundation 224 having one or more foundation block-outs 252. Floor 114 is configured with a chase 232 location corresponding with the block-out 252. Foundation 224 can be configured to have one or more block-outs 252. Likewise, floor 114 is configured to include one or more chase 232 locations corresponding with the one or more block-outs 252. In at least one aspect, the addition of the one or more chase 232 locations in the floor 114 and or walls of modular unit 100 make it possible to set modular unit 100 directly on top of or nearly directly on top of foundation 224. For example, a crawl space is often used in traditional modular building construction for routing electrical, plumbing 230 (e.g., water and sewer), gas, cable, internet, and other utilities. The absence of the crawl space decreases the cost of the foundation 224, allows for flexibility with aligning chase 232 locations with block-outs 252 in a concrete foundation 224, and facilitates use of traditional foundations construction practices. In at least one instance, each modular unit 100 is set upon one or more crush plates 180 disposed atop foundation 224. For example, one or more crush plates 180 are disposed between structural elements (e.g., floor 114, walls 112, 114, framework 233 for chases 232) of each modular unit 100 and the foundation 224. Chase 232 locations in the modular unit 100 are constructed with a framework 233 of dimensional lumber. The framework 233 can be covered with sheathing, drywall, or other suitable materials. The framework 233 of the chase 232 is configured in on aspect into floor 114 to have a position corresponding with one or more foundation 224 block-outs 252. Thus, one or more crush plates 180 are set upon foundation 224 and modular units 100 are set upon the one or more crush plates 180 with one or more chase 232 locations being aligned and positioned with one or more foundation 224 block-outs 252. In another aspect, the framework 233 of the chase 232 is configured into one or more of walls 110, 112 and/or end walls 162, 164 to have a position corresponding with one or more foundation 224 block-outs 252. Thus, one or more crush plates 180 are set upon foundation 224 and modular units 100 are set upon the one or more crush plates 180 with one or more chase 232 locations disposed in wall 110, 112 and/or end wall 162, 164 and being aligned and positioned with one or more foundation 224 block-outs 252. Electrical, plumbing 230 (e.g., water and sewer), gas, cable, internet, and other utilities in a modular unit 100 are connected to electrical, plumbing 230 (e.g., water and sewer), gas, cable, internet, and other utilities in a foundation 224 block-out 252.

FIG. 13 illustrates a modular floor 260 configuration for modular unit 100. The modular floor 260 replaces floor 114 in the modular unit 100. The modular floor 260 is configured to be a temporary structure for maintaining the structural integrity of the modular unit 100 during shipping/delivery. The modular floor 260 includes one or more structural elements from suitable dimensional lumber. For example, the modular floor 260 can include one or more floor joists 262 connected to opposing walls 110, 112 and opposing end walls 162, 164. One or more suitable cross supporting members are connected between opposing one or more floor joists 262 to tie the modular floor 260 structure together. A portion of the wall 110, 112 and end walls 162, 164 include an unfinished portion 264. In one configuration, the bottom 18 inches of each wall includes the unfinished portion 264. The unfinished portion 264 is, in at least one aspect, lacking the finished wall surface (e.g., drywall, wallboard, wall covering) and any products or furnishings that would otherwise be mounted before modular unit 100 is transported to the site of a modular building 200 construction project. For example, plumbed furnishings 258 may be installed in the modular unit 100 at the modular unit factory/plant. Other furnishings 256 may also be mounted before modular unit 100 is transported to the site of a modular building 200 construction project. The modular unit 100 is set on foundation 224 as shown. One or more crush plates, as shown in FIG. 12, can be disposed between modular unit 100 and foundation 224. The modular floor 260 is removed when the modular unit 100 is set in place atop foundation 224. The unfinished portion 264 is installed and finished after the modular unit 100 is set on foundation 224. The unfinished portion 264 is installed and finished, for example, by installing the finished wall surface (e.g., drywall, wallboard, wall covering) and any products or furnishings that would otherwise have been mounted at the modular unit 100 factory before modular unit 100 is transported to the site of a modular building 200 construction project. A Foundation 224 can be the floor of the modular unit 100. Alternatively, a floor 114 can be completed atop foundation 224. A floor finishing can be installed atop foundation 224 or floor 114. In another configuration, the modular unit 100 is set upon another modular unit 100 supported and set upon foundation 224. In this configuration, the ceiling truss 128 and ceiling framework provide a floor for the above modular unit after the modular unit 100 is set atop a below modular unit 100 and when the modular floor 260 is removed. In this configuration, one or more crush plates 178 can be disposed between the stacked modular units 100.

Figure 9:
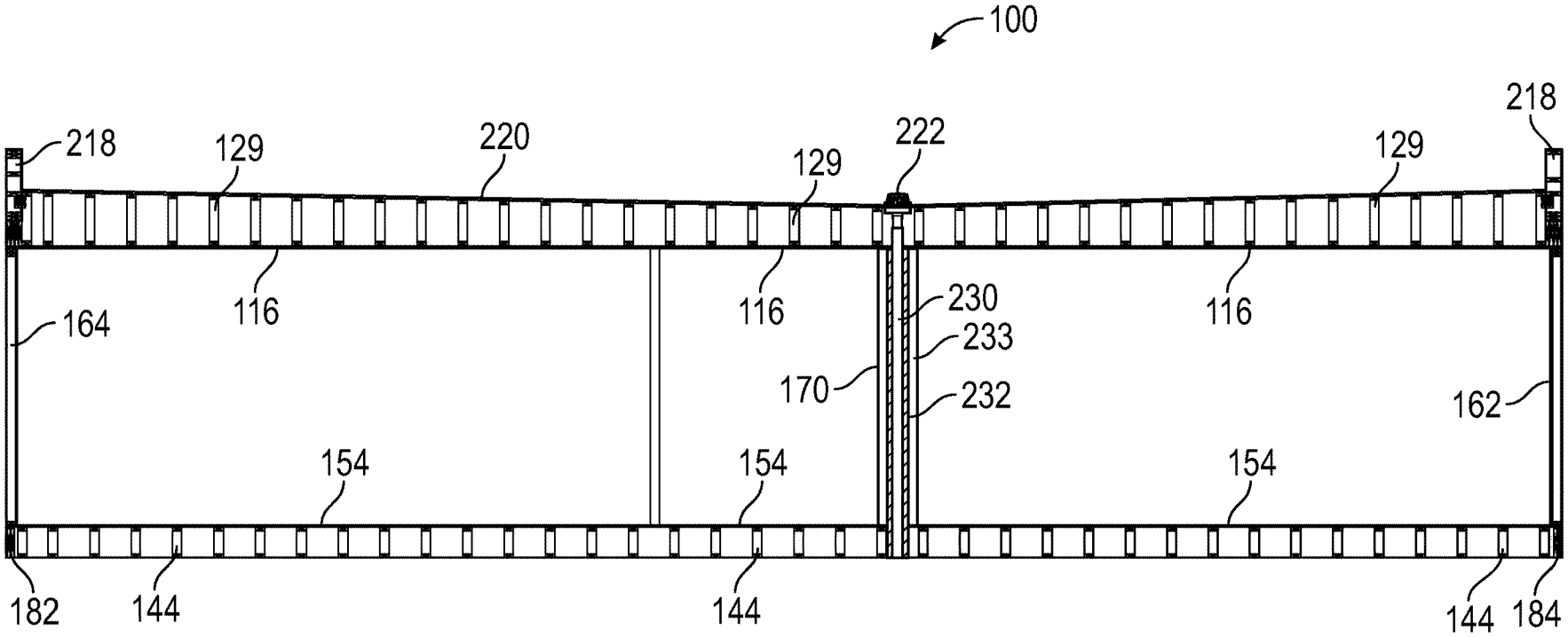
FIG. 9 is sectional view taken along line 9-9 in FIG. 8 of a top floor volumetric modular unit illustrating a sloped roof and drainage system for constructing a modular constructed building in accordance with an illustrative aspect of the disclosure.
Figure 10:
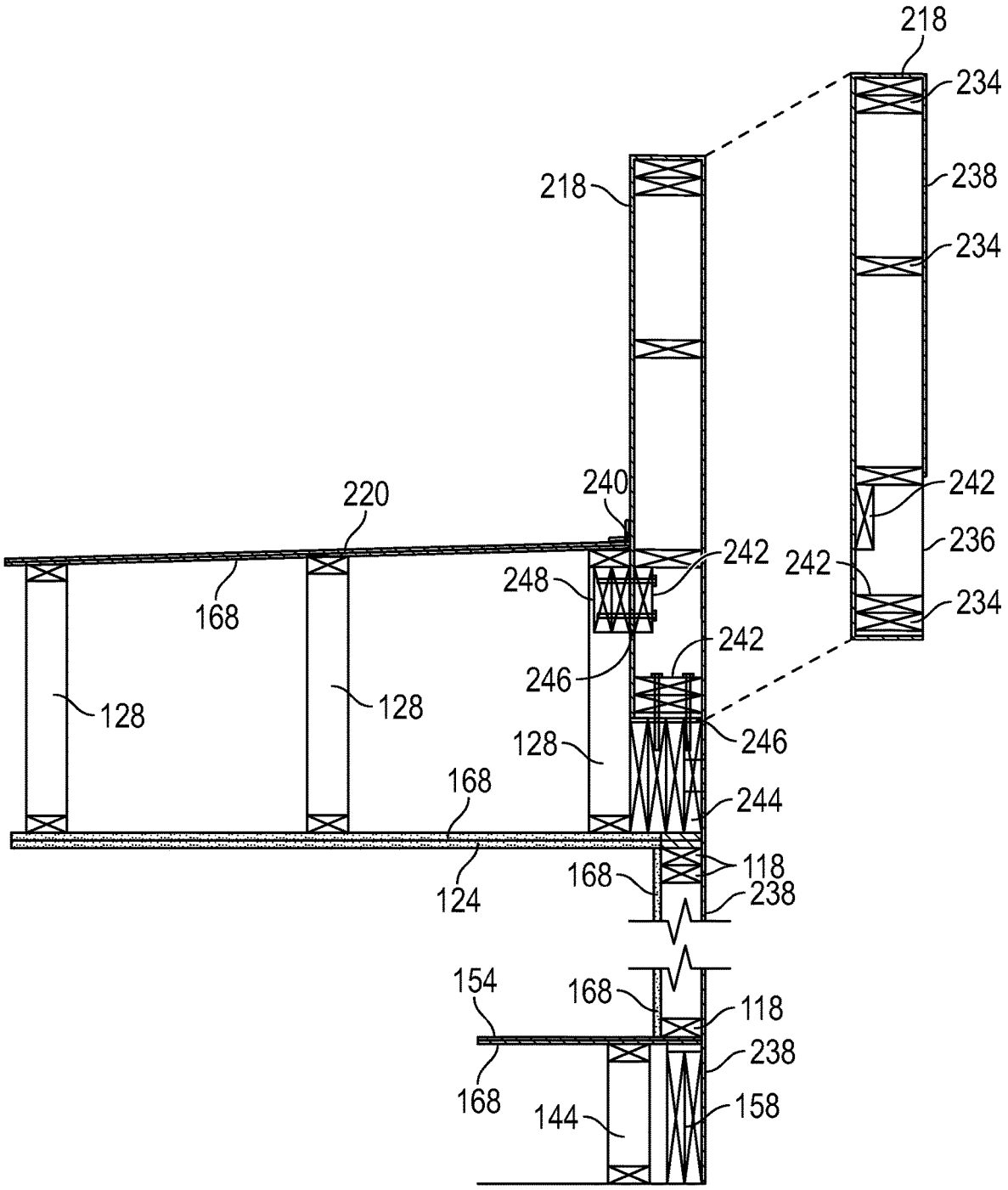
FIG. 10 is an enlarged view of a roof and parapet assembly of a volumetric modular unit taken along line 10-10 in FIG. 8 shown in the vertical position with an exploded view of the parapet and a middle portion of the wall of the volumetric modular unit not shown for purposes of illustrating the enlarged view.
Figure 11:
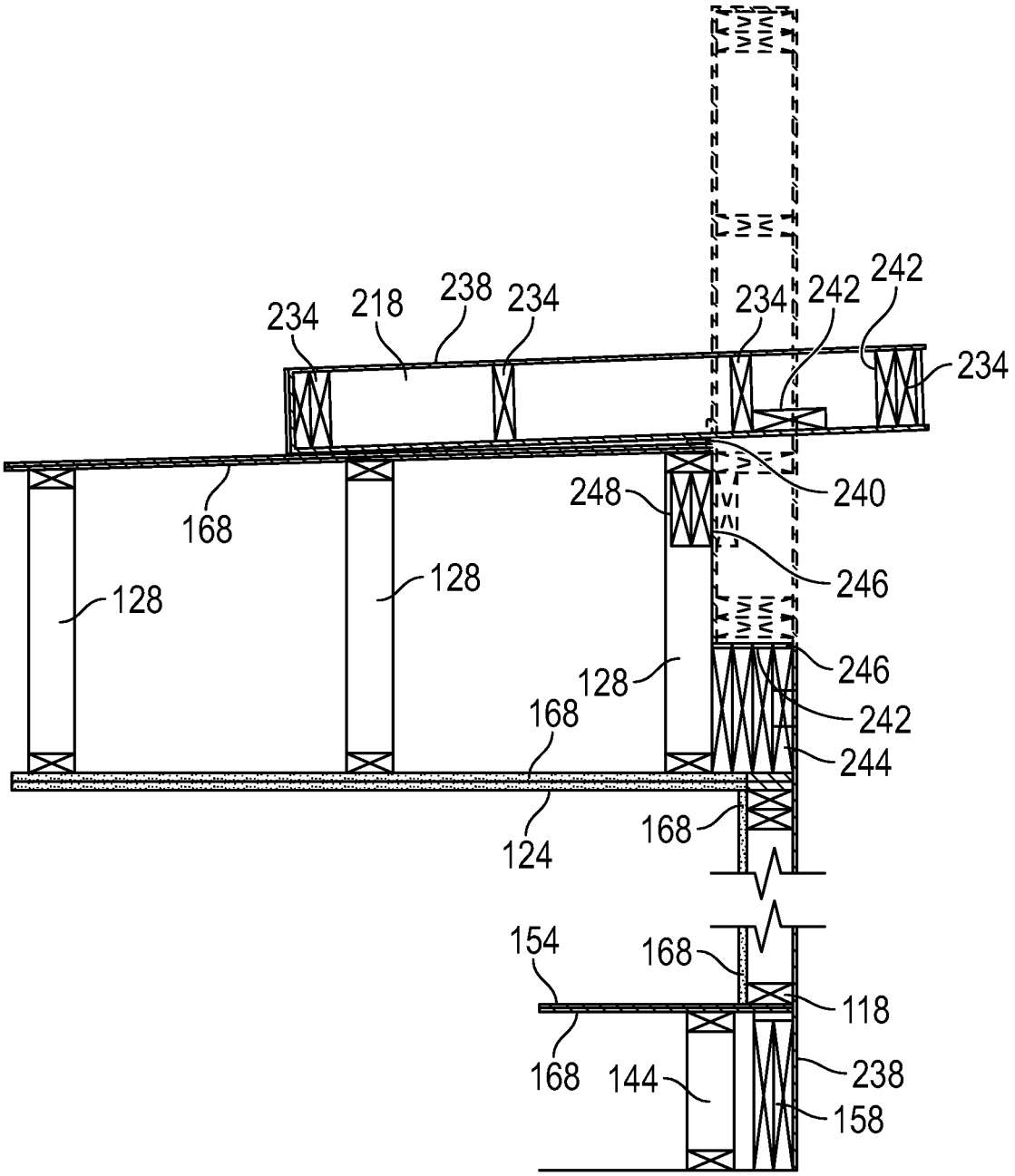
FIG. 11 is another view of the parapet assembly of FIG. 10 with the parapet assembly shown in a horizontal position in accordance with an illustrative aspect of the disclosure.

FIG. 8 illustrates a building 200 with finished roof 220 with roof drains 222 operably connected to plumbing 230 plumbed through a chase 232 fabricated within each volumetric modular unit 100. FIG. 9 provides an illustration of a single volumetric modular unit 100 fabricated at modular unit factory having a roof 220 constructed from roof trusses 129 that vary in vertical height between the opposing end walls 162, 164. In one aspect, trusses 129 have a greater vertical height at the end walls 162, 164 and less vertical height at the roof drain 222. A sheathing layer can be laid over the roof trusses 129 and a roofing material, such as a thermoplastic polyolefin (TPO) or ethylene propylene diene terpolymer (EPDM), can be laid on top of the sheathing layer or the trusses for each of the top floor units. Roof insulation can be incorporated into cavities of the trusses 129. Additional Polyisocyanurate (Polyiso) insulation, which is a closed-cell, rigid foam board insulation, can be easily added on-site if the building code requires it for the location of the modular constructed building. Volumetric modular units 100 can be fabricated at a factory with the roof trusses 129 that vary in height to provide a sloped roof 220 that is sloped to urge water to the roof drain 222. A sloped roof volumetric modular unit 100 can be shipped from a volumetric modular unit factory to a modular building construction site and still comply with shipping requirements and restrictions, such as requirements and restrictions governing highway transportation of freight, including being compliant with permissible height restrictions. For example, the varied vertical height ceiling or roof trusses 129 meets the height transportation restrictions for highway transport, which saves significant time, resources and costs over traditional roof construction that is done entirely at the modular building construction site by using on-site tapered insulation to create a sloped roof from a thermoplastic polyolefin (TPO), ethylene propylene diene terpolymer (EPDM), or other roofing system over top of ceiling or roof trusses that all have the same height. Roof drains 222 can be easily located, positioned overtop of chases 232, and easily completed on-site since chases 232 for plumbing 230 having already been constructed into each volumetric modular unit 100 from dimensional lumber 234 at a volumetric modular unit factory. For example, in one aspect, roof drains 222 can be plumbed to plumbing 230 (FIG. 12) by connecting plumbing through the aligned chases 232 in each stacked modular unit (e.g., first floor 212, second floor 214, and third floor 216).

Safety requirements often necessitate the construction of temporary restraining features atop a roof where construction work is ongoing. Traditional modular construction practices often include constructing temporary restraining features onsite atop a roof which are removed and replaced with a parapet that is also constructed onsite and forms a final part of the finished building. Roof restraining features are expensive, take time to build and take down, and increase the overall time needed to finish a building project. FIGS. 8-11 provide illustrations of a parapet 218 feature for a modular unit constructed building 200 or a modular building 200. The parapet 218 feature is fabricated at a volumetric modular unit factory and shipped with the volumetric modular unit 100 to the construction site. In one configuration, the parapet 218 is fabricated and rotatably attached to the modular unit 100 at the modular unit factory. Once the volumetric modular unit 100 is lifted and set in place on the modular building 200, the parapet 218 can be permanently installed by rotating the parapet 218 from its horizontal or nearly horizontal (shipping) position (FIG. 11) to a vertical (installed) position (FIGS. 9-10) to provide both a finished parapet 218 and a permanent restraining barrier to allow roof construction work to progress nearly concomitantly with the setting of each volumetric modular unit 100. A parapet 218 is often constructed on the site of a modular building construction project due to transportation height restrictions. Even if a parapet is installed on a modular unit and shipped with the volumetric modular unit to the construction site, the height of the parapet is limited by transportation height restrictions, which means that additional height has to be added to the parapet on the site of the modular building construction project. Thus, the additional parapet height cannot be added at the volumetric modular unit factory and shipped to the modular building construction site having the desired parapet height due to transportation height restrictions. The parapet 218 illustrated in FIGS. 8-11 is not limited by shipping height restrictions and can be constructed having any desired parapet height since the parapet 218 height does not increase the height of the volumetric modular unit 100 when the parapet 218 is attached to the modular unit and is in a horizontal position (FIG. 11) during shipping. Thus, parapet 218 height is not restricted by shipping height restrictions and can have any desired height since the modular unit 100 is shipped with the parapet 218 in the horizontal position.

A parapet 218 is generally constructed from dimensional lumber 234 and has a height exceeding its thickness by several if not many factors and a length, for example, spaced between terminal ends 219 (FIG. 8). The parapet 218 includes a sheathing layer 236 fabricated on the outside of a parapet frame constructed from dimensional lumber 234. An exterior finish material 238 can be fabricated over the sheathing layer 236 to provide a finished parapet 218. The length of parapet 218 generally spans between wall 110, 112 and between end walls 162, 164 for outside volumetric modular units 100, and spans between wall 110, 112 or between terminal ends 219 for inside volumetric modular units 100 (FIG. 8). The portion of the parapet 218 extending between end walls 162, 164 can be configured as a unitary (single) parapet or divided into separate, two or more, sections that can rotate from a horizontal position to a vertical position independent of each other. The parapet 218 is connected to roof 220 with a rotatable member/mechanism, such as a hinge 240. Other rotating connection features can be used to provide a hinging mechanism between parapet 218 and roof 220. For example, a living hinge can be configured whereby the parapet 218 can be rotated from a horizontal position to a vertical position using one or more or a single living hinges. One side of the hinge 240 is attached to the roof 220 and the other side of the hinge attached to the parapet 218. Thus, parapet 218 can be rotated from a horizontal (shipping/transport position) to a vertical (installed) position using hinge 240. The roof 220 of a volumetric modular unit 100 can be fabricated to include rim joists 244, 248 secured, for example, adjacent or to ceiling or roof truss 128 to provide anchor points 246 for securing to anchor points 242 of parapet 218. Rim joists 244, 248 can be constructed from dimensional lumber, such as doubled or tripled-up 2×4s, 2×6s, 2×6s, 2×8s, 2×10s, or 2×12s. Similarly, terminal ends 219 of parapet 218 for each volumetric modular unit 100 can be fastened together to provide a continuous parapet 218 from ends to ends and sides to sides of roof 220. Any suitable mechanism for securing anchor points 242 of parapet 218 to anchor points 246 of roof 220 at a modular unit factory may be used, including bolts and nuts, lag bolts, screws, nails, and/or structural adhesives.

The present disclosure contemplates that parapet 218 can be detached from modular unit 100 during shipping. For example, parapet 218 sections may be temporarily fastened atop the modular unit 100 during shipping and hingeably fastened to the modular unit 100 before being lifted and set in place. In at least one aspect, modular unit 100 is lifted and set in place atop modular building 200, the parapet 218 is moved to the vertical (installed) position, and anchor points 246 are secured to anchor points 242 of parapet 218 to allow regulation-compliant work atop the roof 220 to safely commence. In another aspect, the parapet 218 is moved to the vertical (installed) position, anchor points 246 are secured to anchor points 242 of parapet 218, and the modular unit 100 is lifted and set in place atop modular building 200 to allow regulation-compliant work atop the roof 220 to safely commence.

Figure 14:
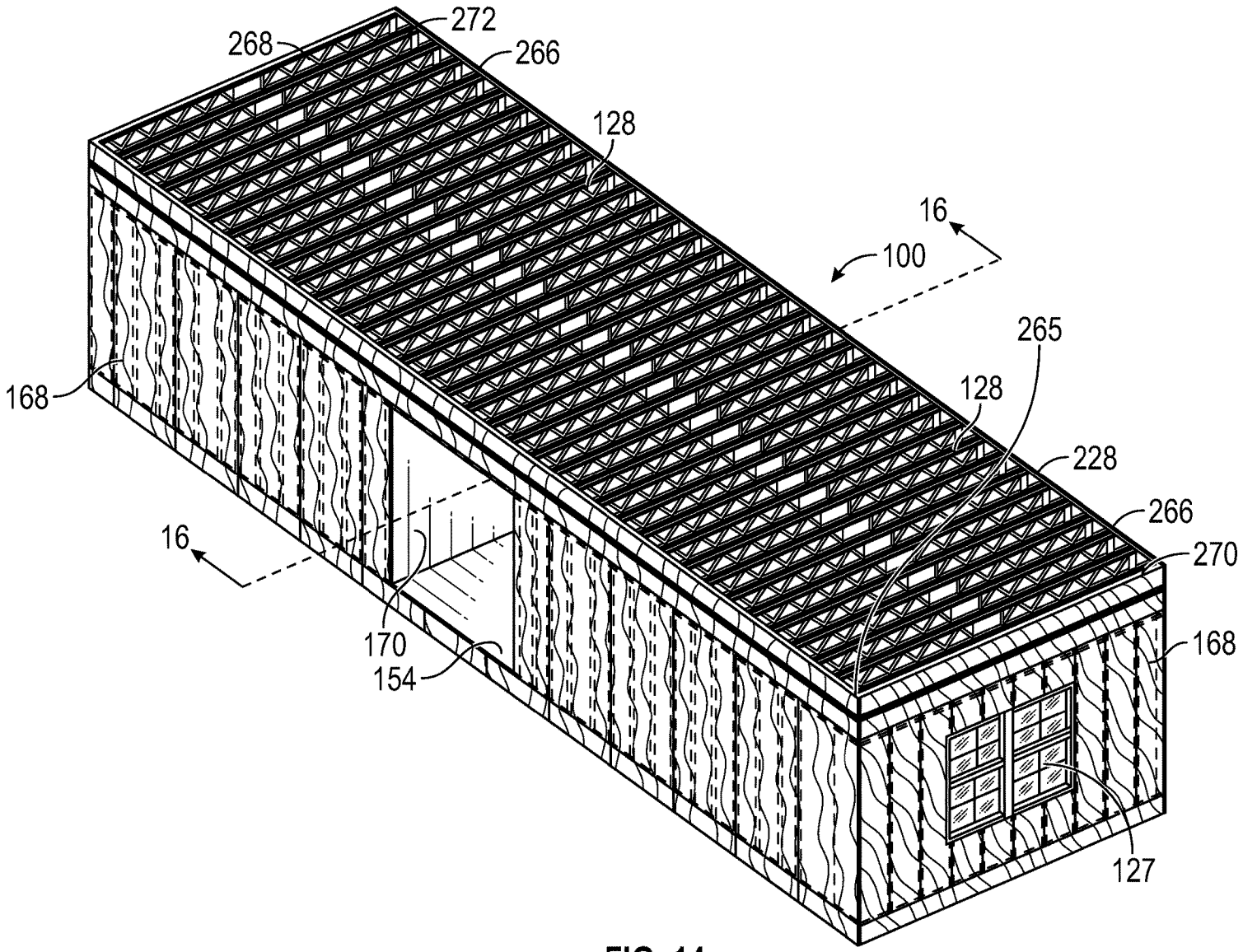
FIG. 14 an isometric view of a volumetric modular unit showing a spacer module for constructing a modular constructed building with volumetric modular units in accordance with an illustrative aspect of the disclosure.
Figure 15:
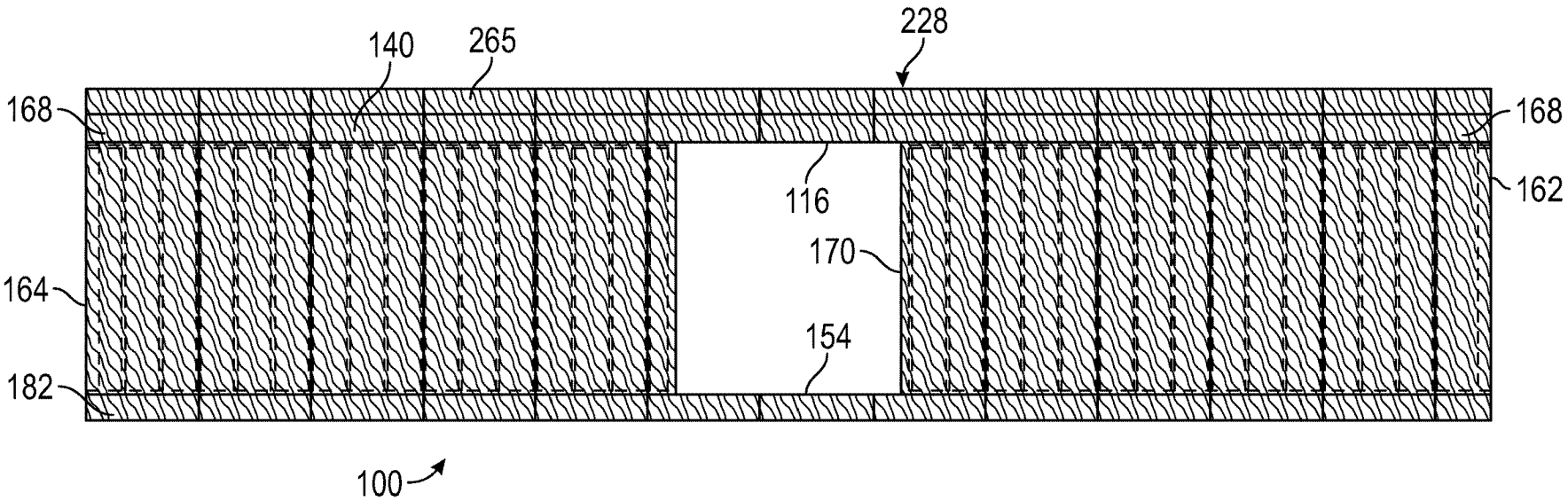
FIG. 15 is a side elevation view of the volumetric modular unit shown in FIG. 14.
Figure 16:
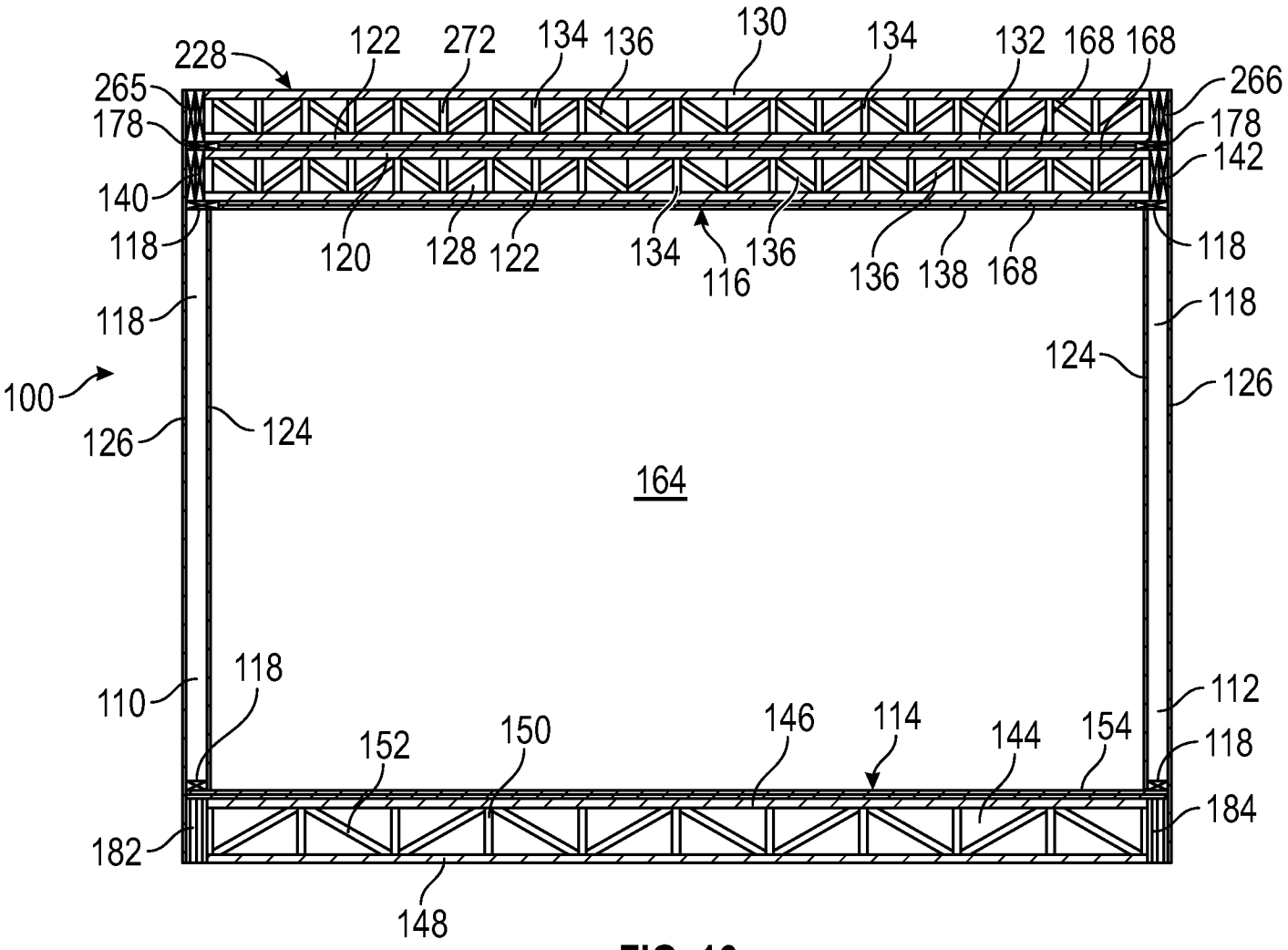
FIG. 16 is a cross-section view of the volumetric modular unit and spacer module taken along line 16-16 in FIG. 14.
Figure 17:
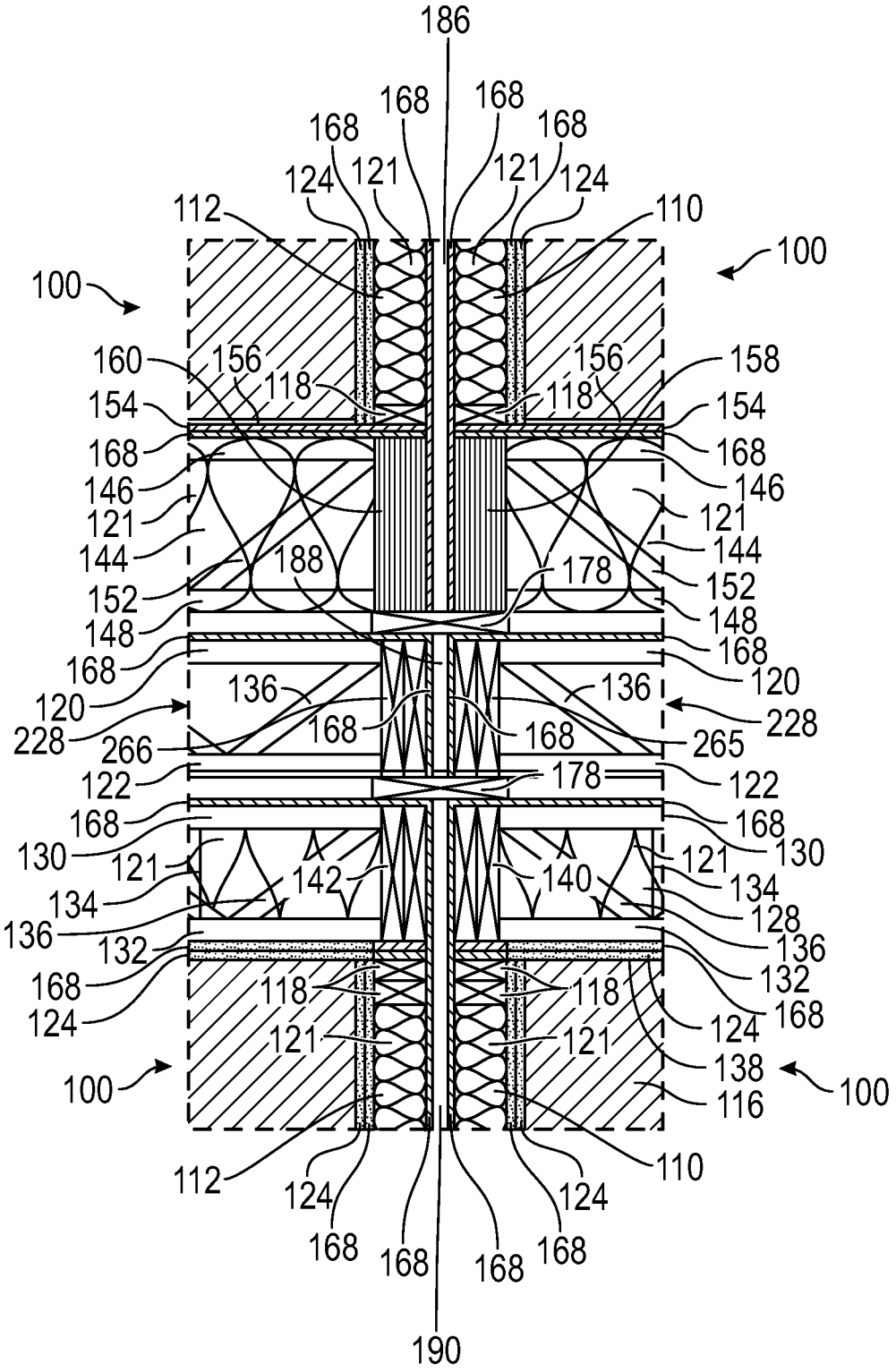
FIG. 17 is a sectional view taken along line 17-17 in FIG. 8 illustrating the volumetric modular units and spacer modules for constructing a modular constructed building in accordance with an illustrative aspect of the disclosure.

FIGS. 8 and 14-17 disclose features of a volumetric modular unit 100 and modular building 200 addressing building 200 misalignment issues and shipping height restrictions, such as, for example, accounting for variation in height between a volumetric modular unit 100 and non-modular constructed portion of modular building 200 while also addressing shipping height and distance restrictions. One example of this is found in the creation of non-modular constructed spaces within modular building 200 having ceiling heights exceeding the permissible or economically viable transportation height of volumetric modular unit 100. As shown in FIG. 8, modular building 200 includes a non-modular constructed space, such as a pedestal 202, constructed atop foundation 224. The space 202 includes vertical walls 206 with windows 208 and a door 210. The height of the vertical wall 206 and resulting ceiling height exceeds the permissible or economically viable transportation height of volumetric modular unit 100. Non-modular construction practices are typically employed at the modular building construction site to add the requisite height to a volumetric modular unit 100 so that the modular units 100 are aligned across the span of a floor or across the span of a space having the same desired elevation. Adding height to each modular unit 100 onsite of the modular building project using non-modular building techniques is expensive, creates bottlenecks in the building process, and ultimately delays completion. FIG. 8 illustrates how aspects of the present disclosure are employed at the modular building construction site to add the requisite height to a volumetric modular unit 100 on the first floor 212 so that the modular units 100 on the second floor 214, third floor 216, and subsequent floors are aligned. Such would result in the floor of each hallway 170 of each modular unit 100 being aligned or residing in the same horizontal plane. In at least one example, a spacer module 228 can be disposed between two volumetric modular units 100 to insure alignment of volumetric modular units 100 on each floor 212, 214, 216, and subsequent floors of modular building 200. Spacer module 228 is fabricated at a plant, such as a plant for manufacturing volumetric modular units 100. Due to shipping restrictions and permissible or economically viable transportation heights of modular unit 100, it is generally not feasible to ship a modular unit 100 with additional construction atop of the modular unit 100 for providing additional height to the modular unit 100 to address spacing and alignment issues in the modular unit constructed building. Spacer module 228 is preferably fabricated at a plant and shipped detached from the modular unit 100. Beneficially, multiple spacer modules 228 can be shipped together to a modular building construction site. Fabricating spacer modules 228 at a factory saves labor, material, and overall construction costs. Additionally, fabricating and shipping spacer modules 228 to a modular building construction site does not burden or unnecessarily extend the construction timeline. Spacer modules 228 are set in place atop of a modular unit 100 (FIGS. 14-16). A volumetric modular unit 100 is set on or placed atop of the spacer module 228 (FIG. 17). Any suitable mechanism for securing spacer module 228 to modular unit 100 both below and above may be used, including bolts and nuts, lag bolts, screws, nails, and/or structural adhesives. Additionally, one or more crush plates 178 can be disposed between adjoining surfaces of a modular unit 100 and spacer module 228.

FIGS. 14-17 provide an exemplary illustration of a fabricated spacer module 228. Spacer module 228 can be fabricated from dimensional lumber, trusses, and joists. In one example, spacer module 228 includes trusses 272 akin to ceiling trusses 128 spaced apart across its length. Each spacer truss 272 is fabricated from a top chord 130 and bottom chord 132 connected by webs, such as a post 134 and diagonal 136. The spacer trusses 272 may be any type of truss, such as a 9¼" trusses spaced apart 24" O.C. or other suitable trusses and spacing. Insulation 121, such as faced/unfaced batting insulation, sound attenuation batting (SAB) insulation, or other suitable insulations, may be disposed within spacer trusses 272. Alternatively, spacer module 228 may be fabricated without insulation. Spacer rim joist 265 is connected to the (left side) ends of the spacer trusses 272. Similarly, spacer rim joist 266 is connected to the (right side) ends of the spacer trusses 272. Spacer rim joist 268 is connected to both spacer trusses 265, 266 and, in one aspect, also connected to a spacer trust 272. Similarly, spacer rim joist 270 is connected to both spacer trusses 265, 266 and, in one aspect, also connected to a spacer trust 272. Spacer rim joists 265, 266, 268, 270 can be constructed or assembled from dimensional lumber, such as doubled or tripled-up 2×10s or 2×12s, or other suitable lumber sizes. Both the underside and topside, one of the sides (FIG. 16) or no sides of spacer module 228 can include sheathing 168. In one aspect, all sides of spacer module 228 are finished with sheathing (FIG. 17). Any suitable mechanism for assembling spacer module 228 using spacer trusses 272, spacer rim joists 265, 266, 268, 270 and sheathing 168 along with other features may be used, including bolts and nuts, lag bolts, screws, nails, and/or structural adhesives.

For example, the figures, such as FIG. 17, provide an exemplary illustration for the orientation, mating, alignment, and connection at the floor 113, ceiling 116, and walls 110, 112 of each modular unit 100 with a spacer module 228 of the assembled modular unit constructed building 200. Adjoining floor 114 portions of modular units 100 are illustrated pictorially at the top of the figure. Adjoining ceiling 116 portions of the modular units 100 are illustrated pictorially at the bottom of the figure. Adjoining spacer module 228 portions of the modular units 100 are illustrated pictorially at the center of the figure.

Left and right adjoining walls 110, 112 in the top and bottom pair (both left and right units) of modular units 100 are illustrated. Walls 110, 112, as discussed in the detailed description, are framed from dimensional lumber such as 2×4s (e.g., for interior walls) or 2×6s (e.g., exterior walls) and include wall studs 118 connected between a top plate 120 and a bottom plate 122. The wall studs 118 may be spaced apart 16" on-center (O.C.). Insulation 121, such as sound attenuation batting (SAB) insulation or other suitable insulations, may be disposed within walls 110, 112, such as between wall studs 118. The interior side of walls 110 typically include an interior wall 124 of sheetrock, such as one or multiple layers of ⅝" gypsum wall board (GWB) and the exterior side of walls 110, 112 includes an exterior wall 126, of one or multiple reinforcing structures, such as sheathing 168 with chipboard/particle board or oriented strand bord (OSB), such as 7/16" OSB sheathing 168.

The floor 114 of each adjoining modular unit 100 includes a floor truss 144 with a top chord 146 and bottom chord 148 connected by webs, such as a post 150 and diagonal 152. The floor truss 144 may be any type of floor truss, such as an 11⅞" floor truss spaced apart 16" O.C. or other suitable floor trusses and spacing. Other suitable sizes, arrangements, and construction of floor trusses 144 are contemplated. For example, floor truss 144 may be constructed from two-by solid lumber, such as 2 inches by 8 inches, 2 inches by 10 inches, 2 inches by 12 inches, with various spacing. Other suitable sizes, arrangements, and construction of the floor trusses 144 are also contemplated, such as, for example, a truss joist, I-joist, and a metal web system (e.g., Posi-Struts by MiTek). Insulation 121, such as sound attenuation batting (SAB) insulation, unfaced batting insulation or other suitable insulations, may be disposed within floors 114. The interior side of floor 114 typically includes a subfloor 154, such as 23/32" OSB or other suitable sheathing 168, and a finished floor 156, such as carpet, wood, linoleum, and tile. One or multiple laminated lumbers 158 are connected to the floor truss 144 and the bottom plate 122 of wall 110 and one or multiple laminated lumbers 160 are connected to the floor truss 144 and the bottom plate 122 of wall 112 thereby providing a reinforcing structure to each modular unit 100. One or multiple laminated lumbers 158, 160 can be constructed from laminated veneer lumber (LVL), such as, for example, 5¼ inch by 20 inches by 16 foot pieces of LVL staggered and offset across a full length (e.g., 65 feet) of the modular unit 100. Other suitable sizes, arrangements and construction of the LVL are contemplated), such as, for example, 1¾ inch by 11⅞ inches by 16 foot pieces of LVL stacked multiples together, staggered and offset across a full length of the modular unit 100 and 1¾ inch by 7¼ inches by 16 foot pieces of LVL stacked multiples together, staggered and offset across a full length of the modular unit 100. One or multiple laminated lumbers 158, 160 can be constructed from parallel strand lumber (PSL), such as, for example, 5½ inch by 22 inches by 16 foot pieces of PSL staggered and offset across a full length of the modular unit 100. Other suitable sizes, arrangements and construction of the PSL are contemplated. Although the one or multiple laminated lumbers 158, 160 are contemplated as being constructed from LVL and PSL.

The present disclosure also contemplates construction from Glue Laminated Timber (Glulam), Cross-Laminated Timber (CLT), Nail Laminated Timber (NLT), Dowel Laminated Timber (DLT), and the like. The present disclosure also contemplates using solid lumber in place of the one or more laminated lumbers 158, 160. For example, floor joists can be used in place of the one or more multiple laminated lumbers 158, 160, such as in instances where the modular unit 100 is not spanning an area underneath it that offers no support and therefore may not need the additional structural support from the use of one or more multiple laminated lumbers 158, 160. Floor joists could be constructed or assembled from dimensional lumber, such as doubled or tripled-up 2×10s or 2×12s, or other suitable lumber. Any suitable mechanism for assembling floor 114, one or multiple laminated lumbers 158, 160 and walls 110, 112 along with other features may be used, including bolts and nuts, lag bolts, screws, nails, and/or structural adhesives.

Each adjoining spacer module 228 is shown fabricated from dimensional lumber, trusses, and joists. In one example, spacer module 228 includes trusses 272 akin to ceiling trusses 128 spaced apart across its length. Each spacer truss 272 is fabricated from a top chord 130 and bottom chord 132 connected by webs, such as a post 134 and diagonal 136. The spacer trusses 272 may be any type of truss, such as a 9¼" trusses spaced apart 24" O.C. or other suitable trusses and spacing. Insulation 121 can be included within each spacer module 228, like as shown in the ceiling 116 and floor 114 of each adjoining modular unit 100. Insulation 121, such as faced/unfaced batting insulation, sound attenuation batting (SAB) insulation, or other suitable insulations, may be disposed within spacer trusses 272. Alternatively, spacer module 228 may be fabricated without insulation. The left side portion of spacer module 228 includes a spacer rim joist 265 connected to the (left side) ends of the spacer trusses 272. Similarly, the right side portion of spacer module 228 includes a spacer rim joist 266 connected to the (right side) ends of the spacer trusses 272. Spacer rim joist 268 is connected to both spacer trusses 265, 266 and, in one aspect, also connected to a spacer trust 272. Similarly, spacer rim joist 270 is connected to both spacer trusses 265, 266 and, in one aspect, also connected to a spacer trust 272. Spacer rim joists 265, 266, 268, 270 can be constructed or assembled from dimensional lumber, such as doubled or tripled-up 2×10s or 2×12s, or other suitable lumber sizes. Both the underside and topside, one of the sides (FIG. 16) or no sides of spacer module 228 can include sheathing 168. In one aspect, all sides of spacer module 228 are finished with sheathing (FIG. 17). Any suitable mechanism for assembling spacer module 228 using spacer trusses 272, spacer rim joists 265, 266, 268, 270 and sheathing 168 along with other features may be used, including bolts and nuts, lag bolts, screws, nails, and/or structural adhesives.

Orientation, mating, alignment, and connection at and between the floor 114 of each adjoining modular unit 100 and each adjoining spacer module 228 of the assembled modular unit constructed building 200 is shown in the figures, such as in FIG. 17. In one aspect, a crush plate 178 constructed from dimensional lumber, such as 2×8s, 2×10s, 2×12s, or other suitable dimensions, is disposed between the floors 114 of modular units 100 and the top surface of spacer models 228, which are assembled together into a modular unit constructed building 200. Crush plate 178, also known as an anti-crush plate, are generally used to avoid crushing of the lumber at supports of heavily loaded lumber trusses on wall frames. Crush plate 178 accomplishes this by increasing the width of the bearing and therefore the bearing capacity of the spacer module 228. Crush plate 178 is typically disposed underneath the one or more multiple laminated lumbers 160 of the left modular unit 100, underneath the one or multiple laminated lumbers 158 of the right modular unit 100, above the spacer rim joist 266 of the left spacer module 228, above the spacer rim joist 265 of the right spacer module 228, and spanning a gap 186 between both the left and right modular units 100 and gap 188 between both the left and right spacer modules 228. Modular units 100 are assembled with spacer modules 228 so common features align, such as a hallway 170, breezeway, floors 114, or corridor. Any suitable mechanism for assembling together the crush plate 178, the one or more multiple laminated lumbers 160 of the left modular unit 100, the one or multiple laminated lumbers 158 of the right modular unit 100, the spacer rim joist 266 of the left modular unit 100, and the spacer rim joist 265 of the right modular unit, along with other features may be used, including bolts and nuts, lag bolts, screws, nails, and/or structural adhesives.

The ceiling 116 of each adjoining modular unit 100 includes ceiling trusses 128 with a top chord 130 and bottom chord 132 connected by webs, such as a post 134 and diagonal 136. The ceiling trusses 128 may be any type of ceiling truss, such as a 9¼" ceiling trusses spaced apart 24" O.C. or other suitable ceiling trusses and spacing. Insulation 121, such as faced/unfaced batting insulation, sound attenuation batting (SAB) insulation, or other suitable insulations, may be disposed within ceiling 116. The interior side of ceiling 116 typically includes an interior ceiling 138 of sheetrock, such as one or multiple layers of ⅝" gypsum wall board (GWB) or other suitable wall boards. Top rim joist 142 of the left modular unit 100 are connected to the ends of the ceiling trusses 128 and the top plate 120 of wall 112 providing a reinforcing structure to the left modular unit 100. Similarly, top rim joist 140 of the right modular unit 100 are connected to the ends of the ceiling trusses 128 and the top plate 120 of wall 110 providing a reinforcing structure to the right modular unit 100. Top rim joists 140, 142 can be constructed or assembled from dimensional lumber, such as doubled or tripled-up 2×10s or 2×12s, or other suitable lumber. Any suitable mechanism for assembling ceiling 116, ceiling trusses 128, top rim joists 140, 142 and walls 110, 112 along with other features may be used, including bolts and nuts, lag bolts, screws, nails, and/or structural adhesives.

Orientation, mating, alignment, and connection at and between the ceiling 116 of each adjoining modular unit 100 and each adjoining spacer module 228 of the assembled modular unit constructed building 200 is shown in the figures, such as in FIG. 17. In one aspect, a crush plate 178 constructed from dimensional lumber, such as 2×8s, 2×10s, 2×12s, or other suitable dimensions, is disposed between the ceiling 116 of modular units 100 and the bottom surface of spacer models 228, which are assembled together into a modular unit constructed building 200. Crush plate 178, also known as an anti-crush plate, are generally used to avoid crushing of the lumber at supports of heavily loaded lumber trusses on wall frames. Crush plate 178 accomplishes this by increasing the width of the bearing and therefore the bearing capacity of the spacer module 228. Crush plate 178 is typically disposed above the top rim joist 142 of the left modular unit 100, above the top rim joist 140 of the right modular unit 100, beneath the spacer rim joist 266 of the left spacer module 228, beneath the spacer rim joist 265 of the right spacer module 228, and spanning a gap 190 between both the left and right modular units 100 and gap 188 between both the left and right spacer modules 228. Modular units 100 are assembled with spacer modules 228 so common features align, such as a hallway 170, breezeway, ceiling 116, or corridor. Any suitable mechanism for assembling together the crush plate 178, the rim joist 142 of the left modular unit 100, the rim joist 140 of the right modular unit 100, the spacer rim joist 266 of the left modular unit 100, and the spacer rim joist 265 of the right modular unit, along with other features may be used, including bolts and nuts, lag bolts, screws, nails, and/or structural adhesives.

The invention is not to be limited to the particular aspects described herein. In particular, the disclosure contemplates numerous variations in a laminated lumber constructed modular unit for modular building construction, as best illustrated in FIGS. 1-17. The foregoing description has been presented for purposes of illustration and description. It is not intended to be an exhaustive list or limit any of the invention to the precise forms disclosed. It is contemplated that other alternatives or exemplary aspects are considered included in the disclosure. The description is merely examples of embodiments, processes, or methods of the invention. It is understood that any other modifications, substitutions, and/or additions can be made, which are within the intended spirit and scope of the disclosure.

What is claimed is:

1. A volumetric modular unit for constructing a modular building, comprising:

a floor structure and a ceiling structure interconnected by opposing side wall structures and opposing end wall structures;

a plurality of wall studs disposed within the opposing side wall structures and the opposing end wall structures;

a plurality of floor support members disposed within the floor structure; and a plurality of ceiling support members disposed within the ceiling structure, wherein one or more of the plurality of ceiling support members have a vertical height that varies between the opposing end wall structures to provide a slope to a roof of the ceiling structure;

a parapet attached to the ceiling structure, the parapet having a horizontal position for shipping the modular unit and rotated to a vertical installed position during construction of the modular building, wherein the ceiling structure includes a parapet mounting slot located below the roof and wherein a lower portion of the parapet is rigidly fixed to the ceiling structure at the parapet mounting slot in the vertical installed position.

2. The volumetric modular unit of claim 1, further comprising:

a roof disposed atop the plurality of ceiling support members, wherein the roof extends downwardly horizontally away from the opposing end wall structures following the slope from the variation in vertical height of the ceiling support members.

3. The volumetric modular unit of claim 1, wherein the vertical height of each of the plurality of ceiling support members varies between the opposing end wall structures.

4. The volumetric modular unit of claim 1, wherein the vertical height decreases for a first set of the plurality of ceiling support members extending inward from one of the opposing end wall structures to a roof drain.

5. The volumetric modular unit of claim 1, wherein the vertical height increases for a second set of the plurality of ceiling support members extending outward from a roof drain to one of the opposing end wall structures.

6. The volumetric modular unit of claim 1, wherein the plurality of ceiling support members comprise a plurality of roof trusses having the vertical height that varies between the opposing end wall structures to provide a sloped roof.

7. A modular building constructed from volumetric modular units, comprising:

a modular building foundation having one or more block-outs for plumbing;

a volumetric modular unit supported by the foundation, the volumetric modular unit comprising:

a floor structure and a ceiling structure interconnected by opposing side wall structures and opposing end wall structures, wherein the floor structure includes one or more chases constructed at a volumetric modular unit factory corresponding with the one or more block-outs in the modular building foundation for connecting plumbing;

a plurality of wall studs disposed within the opposing side wall structures and the opposing end wall structures;

a plurality of floor support members disposed within the floor structure; and a plurality of ceiling support members disposed within the ceiling structure;

one or more building floors having one or more of the volumetric modular units;

wherein the floor structure is disposed atop the modular building foundation and a load from the volumetric modular unit is transferred directly to the foundation;

a parapet rotatably attached to the ceiling structure at the volumetric modular unit factory, the parapet having:

a shipping position parallel with the ceiling structure for transporting the volumetric modular unit from the volumetric modular unit factory to a modular building construction site, wherein a lower portion of the parapet extends outward beyond the end wall structure; and an installed vertical position, wherein the lower portion of the parapet extends toward the ceiling structure in the installed vertical;

wherein the parapet is rotated from the shipping position to the installed position at the modular building construction site during construction of the modular building.

8. The modular building of claim 7, further comprising:

one or more crush plates disposed between the floor structure and the foundation.

9. The modular building of claim 7, further comprising:

a spacer module operably attachable to the ceiling structure atop the volumetric modular unit, the spacer module having a height defined by a plurality of spacer module support members extending between opposing edge walls and opposing end walls;

wherein a height of the volumetric modular unit is increased by the height of the spacer module for maintaining elevation alignment along the one or more building floors of the modular building.

10. The modular building of claim 7, wherein one or more of the plurality of ceiling support members have a vertical height that varies between the opposing end wall structures to provide a sloped roof.

11. The modular building of claim 7, wherein the plurality of ceiling support members comprise a plurality of roof trusses having a vertical height that varies between the opposing end wall structures to provide a sloped roof for urging water to a roof drain plumbed through the one or more chases and the one or more block-outs.

12. The modular building of claim 7, wherein one or more multiple laminated lumbers are attached to the floor structure between the opposing end wall structures for carrying the load of the volumetric modular unit overtop an open area within the modular building.

13. The modular building of claim 7, further comprising:

a spacer module operably attachable to the ceiling structure atop the volumetric modular unit, the spacer module having a height defined by a plurality of trusses extending between opposing edge joists and opposing end joists;

wherein a height of the volumetric modular unit is increased by the height of the spacer module for maintaining elevation alignment along the one or more building floors of the modular building.

14. A volumetric modular unit for constructing a modular building, comprising:

a floor structure and a ceiling structure interconnected by opposing side wall structures and opposing end wall structures;

a plurality of wall studs disposed within the opposing side wall structures and the opposing end wall structures;

a plurality of floor support members disposed within the floor structure;

a roof structure attached atop the ceiling structure, wherein the roof structure includes a roof and a parapet mounting slot located between the roof and the ceiling structure; and a parapet rotatably attached to the ceiling structure, the parapet having an upper and lower portion and a horizontal shipping position with the upper portion located generally adjacent the roof for transporting the modular unit and rotated to a vertical installed position with the lower portion of the parapet located in the parapet mounting slot during construction of the modular building.

15. The volumetric modular unit of claim 14, further comprising:

a plurality of ceiling support members disposed within the ceiling structure, wherein one or more of the plurality of ceiling support members have a vertical height that varies between the opposing end wall structures to provide a slope to the ceiling structure.

16. The volumetric modular unit of claim 14, wherein a vertical height of a plurality of ceiling support members disposed within the ceiling structure varies between the opposing end wall structures.

17. The volumetric modular unit of claim 14, wherein a vertical height decreases for a first set of a plurality of ceiling support members disposed within the ceiling structure and extending inward from one of the opposing end wall structures to a roof drain.

18. The volumetric modular unit of claim 14, wherein a vertical height increases for a second set of a plurality of ceiling support members disposed within the ceiling structure and extending outward from a roof drain to one of the opposing end wall structures.

19. The volumetric modular unit of claim 14, wherein a plurality of ceiling support members disposed within the ceiling structure comprise a plurality of roof trusses having a vertical height that varies between the opposing end wall structures to provide a sloped roof.

20. The volumetric modular unit of claim 14, wherein the parapet is generally parallel with the ceiling structure in the horizontal position and generally perpendicular with the ceiling structure in the vertical installed position.

* * * * *